US010992018B2

(12) United States Patent
Hirota et al.

(10) Patent No.: US 10,992,018 B2
(45) Date of Patent: Apr. 27, 2021

(54) COAXIAL-WAVEGUIDE-TO-HOLLOW-WAVEGUIDE TRANSITION CIRCUIT

(71) Applicant: Mitsubishi Electric Corporation, Tokyo (JP)

(72) Inventors: Akimichi Hirota, Tokyo (JP); Takeshi Oshima, Tokyo (JP); Naofumi Yoneda, Tokyo (JP); Jun Nishihara, Tokyo (JP); Hiroyuki Nonomura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 201 days.

(21) Appl. No.: 16/304,092

(22) PCT Filed: Jul. 22, 2016

(86) PCT No.: PCT/JP2016/071541
§ 371 (c)(1),
(2) Date: Nov. 21, 2018

(87) PCT Pub. No.: WO2018/016071
PCT Pub. Date: Jan. 25, 2018

(65) Prior Publication Data
US 2020/0328491 A1 Oct. 15, 2020

(51) Int. Cl.
*H01P 5/103* (2006.01)
*H01P 3/06* (2006.01)
*H01P 3/12* (2006.01)

(52) U.S. Cl.
CPC ..... *H01P 5/103* (2013.01); *H01P 3/06* (2013.01); *H01P 3/12* (2013.01)

(58) Field of Classification Search
CPC ..... H01P 5/103; H01P 3/06; H01P 3/12
(Continued)

(56) References Cited

U.S. PATENT DOCUMENTS 3,023,381 A 2/1962 Rowland
3,286,202 A 11/1966 Daveau et al.
(Continued)

FOREIGN PATENT DOCUMENTS

CN 105789805 A 7/2016
DE 1104002 B 4/1961
(Continued)

OTHER PUBLICATIONS

Gemaan Office Action, dated Dec. 4, 2019, for German Application No. 11201600E983.9; with an English translation.
(Continued)

*Primary Examiner* — Rakesh B Patel
*Assistant Examiner* — Jorge L Salazar, Jr.
(74) *Attorney, Agent, or Firm* — Birch, Stewart, Kolasch & Birch, LLP

(57) ABSTRACT

A coaxial-waveguide-to-hollow-waveguide transition circuit (1) includes a hollow waveguide (10), a coaxial waveguide (20) having an end coupled to a wide wall (16) of the hollow waveguide (10), and a strip conductor (30) located inside the internal path (**10*h*) of the hollow waveguide (10). The coaxial waveguide (20) includes a conducting core wire (22) extending into the internal path (10*h*) of the hollow waveguide (10). The strip conductor (30) is located so as to make a short-circuit connection between the conducting core wire (22) of the coaxial waveguide (20) and a termination surface (12) of the hollow waveguide (10**).

11 Claims, 11 Drawing Sheets

(58) Field of Classification Search
USPC ..... 333/24 R, 26
See application file for complete search history.

(56) References Cited

U.S. PATENT DOCUMENTS

| | | | | |
|---|---|---|---|---|
| 3,462,713 | A | 8/1969 | Knerr et al. | |
| 2016/0028164 | A1* | 1/2016 | Watanabe | H01Q 1/36<br>343/771 |

FOREIGN PATENT DOCUMENTS

| | | | |
|---|---|---|---|
| DE | 1766787 | B1 | 12/1971 |
| JP | 62-173803 | U | 11/1987 |
| JP | 5-25804 | U | 4/1993 |
| JP | 2015-103886 | A | 6/2015 |
| JP | 7-254803 | A | 7/2015 |

OTHER PUBLICATIONS

International Search Report (PCT/ISA/210) issued in PCT/JP2016/071541, dated Oct. 11, 2016.
Chinese Office Action dated Aug. 21, 2020 for Application No. 201680087736.4 with an English translation.
Office Action dated Feb. 19, 2021 in corresponding Chinese Application No. 2016 8008 7736.4.

* cited by examiner

COAXIAL-WAVEGUIDE-TO-HOLLOW-WAVEGUIDE TRANSITION CIRCUIT

TECHNICAL FIELD

The present invention relates to a transition circuit for converting a transmission mode between a coaxial waveguide and a hollow waveguide.

BACKGROUND ART

Coaxial-waveguide-to-hollow-waveguide transition circuits are widely used for transmission of signals in high-frequency bands such as the very high frequency (VHF) band, the ultra-high frequency (UHF) band, the millimeter wave band or the microwave band.

For example, Patent Literature 1 (Japanese Utility-Model Application Publication No. 1993(Hei05)-25804) discloses a coaxial-waveguide-to-hollow-waveguide transition circuit which includes a hollow waveguide that has an opening formed at a predetermined position, a dielectric that is inserted through the opening, and a metal probe that is placed so as to protrude into the hollow waveguide through the dielectric. In addition, Patent Literature 2 (Japanese Utility-Model Publication No. 1987(Sho62)-173803) discloses a coaxial-waveguide-to-hollow-waveguide transition circuit which includes a hollow-waveguide portion, a coaxial core wire that extends from a short-circuit surface of the hollow-waveguide portion into the inside of the hollow-waveguide portion, and a magnetic-field coupling transition portion that has a metal plate for coupling a tip of the coaxial core wire to an inner wall (H plane) of the hollow-waveguide portion.

CITATION LIST

Patent Literatures

Patent Literature 1: Japanese Utility-Model Application Publication No. 1993(Hei05)-25804.

Patent Literature 2: Japanese Utility-Model Publication No. 1987(Sho62)-173803.

SUMMARY OF INVENTION

Technical Problem

With the configuration of the coaxial-waveguide-to-hollow-waveguide transition circuit disclosed in Patent Literature 1, a transmission mode (coaxial mode) of the coaxial waveguide and a transmission mode (hollow-waveguide mode) of the hollow waveguide are coupled to each other with respect to the electric field, which thus allows for implementation of electrical characteristics in a broad frequency band. However, there is the problem that, when high electric power is input to the coaxial-waveguide-to-hollow-waveguide transition circuit, thereby causing the tip portion of the metal probe extending into the hollow waveguide to generate heat and thus deformed, the electrical characteristics of the coaxial-waveguide-to-hollow-waveguide transition circuit are largely degraded.

On the other hand, with the configuration of the coaxial-waveguide-to-hollow-waveguide transition circuit disclosed in Patent Literature 2, the heat generated at the tip portion of the core wire extending into the inside of the hollow-waveguide portion can be transferred to the wall of the hollow-waveguide portion even when high electric power is input. Therefore, degradation of the electrical characteristics of the coaxial-waveguide-to-hollow-waveguide transition circuit is suppressed. However, a transmission mode is converted by magnetic field coupling, causing the problem that the electrical characteristics are narrow-band characteristics.

In view of the foregoing, an object of the present invention is to provide a coaxial-waveguide-to-hollow-waveguide transition circuit which allows for implementation of stable broad-band characteristics even when high electric power is input.

Solution to Problem

In accordance with one aspect of the present invention, there is provided a coaxial-waveguide-to-hollow-waveguide transition circuit which includes: a hollow waveguide having a pair of long sides facing each other and a pair of short sides facing each other in a cross section perpendicular to a waveguide-axis direction thereof, the hollow waveguide having, as inner walls, a pair of wide walls forming the pair of long sides and a pair of narrow walls forming the pair of short sides; at least one coaxial waveguide located outside the hollow waveguide and having an end coupled to one wide wall of the pair of wide walls; and a strip conductor located inside an internal path of the hollow waveguide. The hollow waveguide has a termination surface in one end of the hollow waveguide in the waveguide-axis direction. The at least one coaxial waveguide includes at least one conducting core wire extending from the end of the at least one coaxial waveguide into the internal path of the hollow waveguide. The strip conductor makes a short-circuit connection between the at least one conducting core wire and at least one of the termination surface and at least one narrow wall of the pair of narrow walls.

Advantageous Effects of Invention

According to the present invention, the heat generated at a tip portion of the conducting core wire is dissipated by the strip conductor even when high electric power is input, which thus allows for implementation of stable broad-band characteristics.

DESCRIPTION OF EMBODIMENTS

Figure 1:
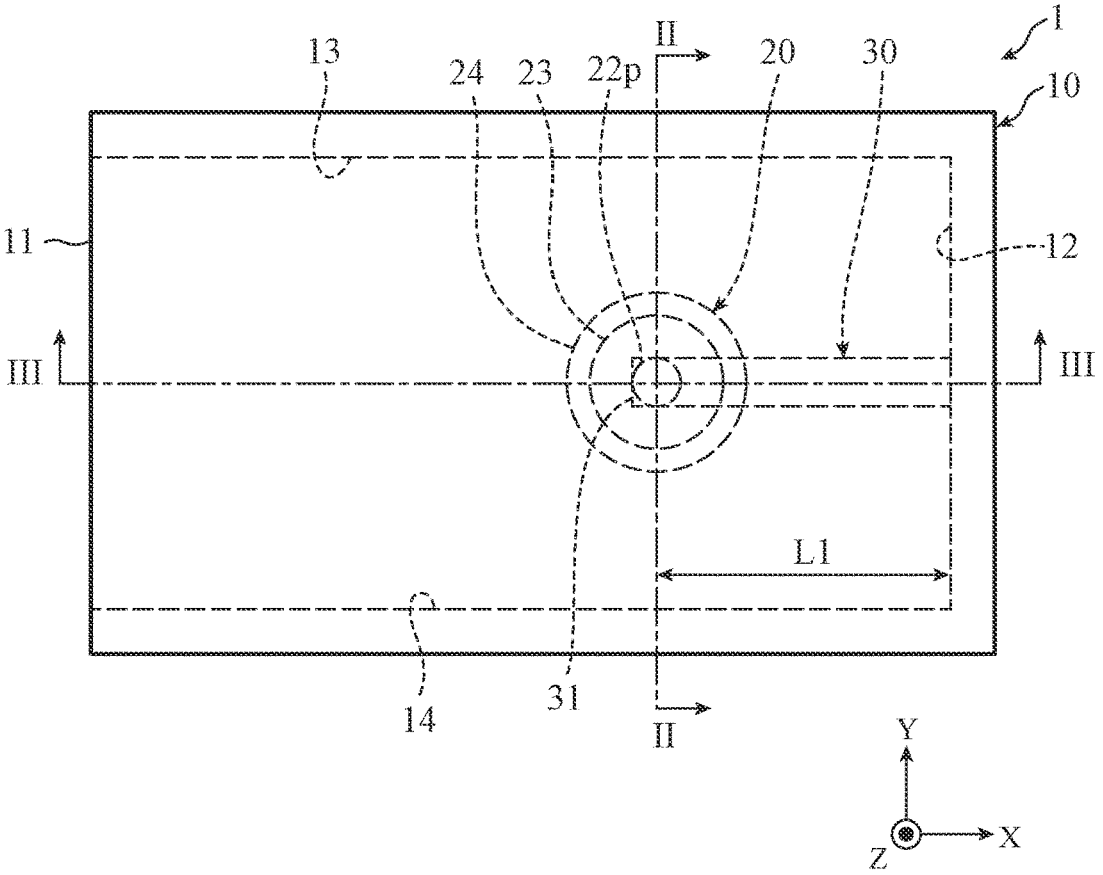
FIG. 1 is a top view illustrating a schematic configuration of a coaxial-waveguide-to-hollow-waveguide transition circuit according to a first embodiment of the present invention.

Hereinafter, various embodiments in accordance with the present invention will be described in detail with reference to the drawings. Note that components denoted by the same symbol throughout the drawings have the same configuration and the same function. In addition, the X-axis, the Y-axis, and the Z-axis as illustrated in the drawings are orthogonal to one another.

First Embodiment

Figure 2:
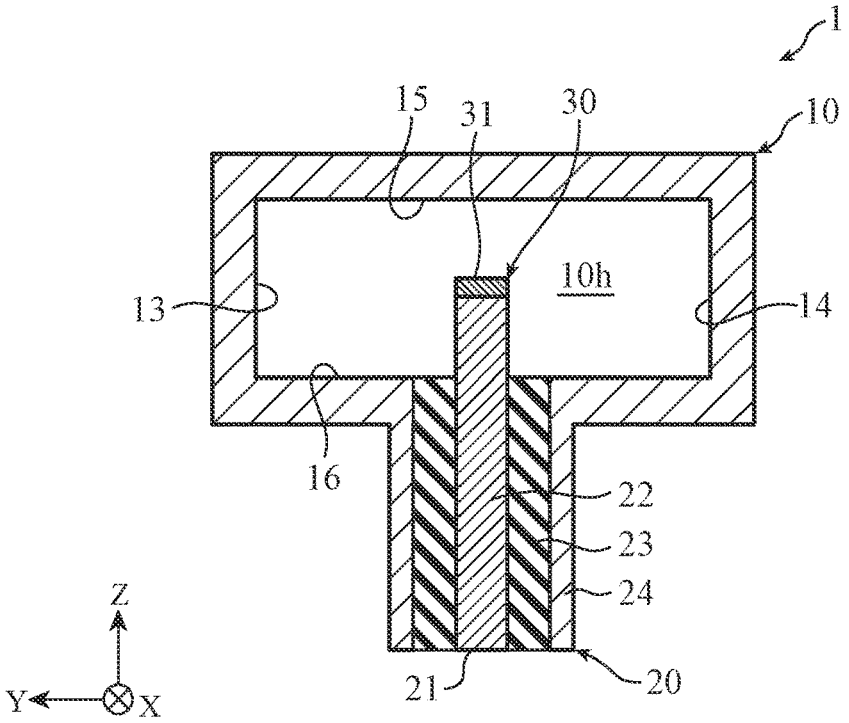
FIG. 2 is a schematic cross-sectional view taken along line II-II of the coaxial-waveguide-to-hollow-waveguide transition circuit illustrated in FIG. 1.
Figure 3:
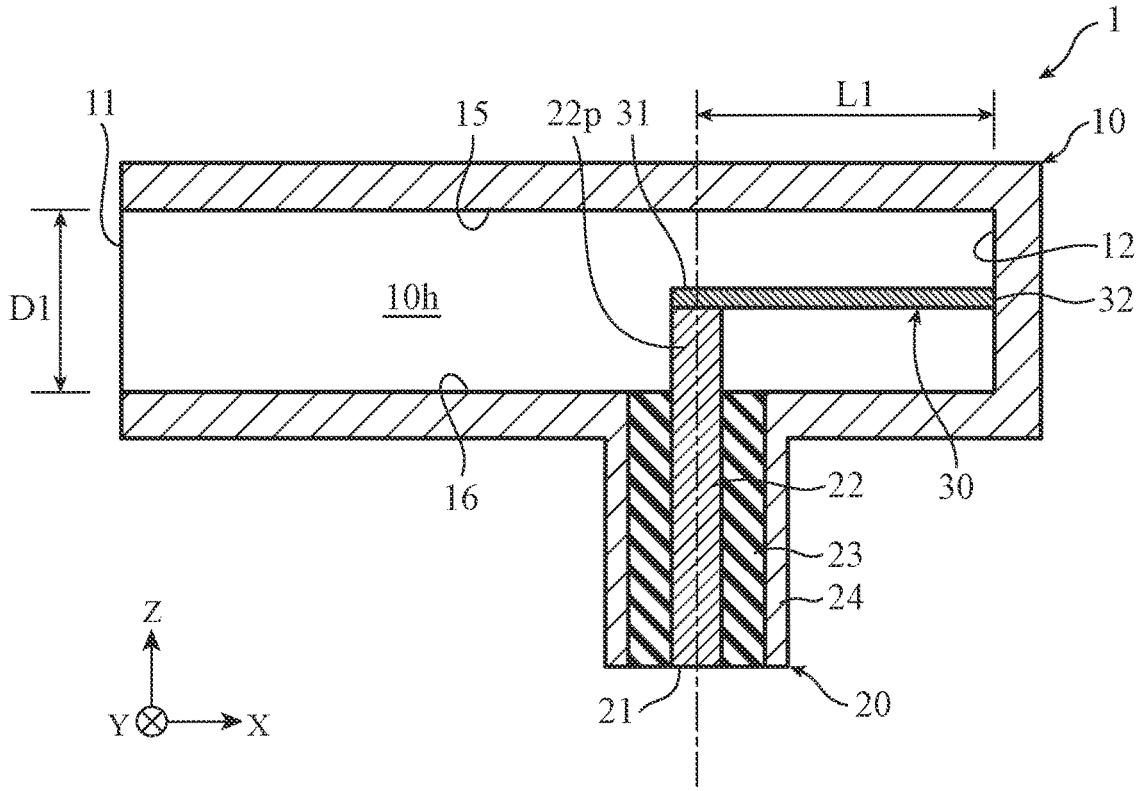
FIG. 3 is a schematic cross-sectional view taken along line of the coaxial-waveguide-to-hollow-waveguide transition circuit illustrated in FIG. 1.

FIG. 1 is a top view illustrating a schematic configuration of a coaxial-waveguide-to-hollow-waveguide transition circuit 1 according to a first embodiment of the present invention. FIG. 2 is a schematic cross-sectional view taken along line II-II of the coaxial-waveguide-to-hollow-waveguide transition circuit 1 illustrated in FIG. 1. FIG. 3 is a schematic cross-sectional view taken along line of the coaxial-waveguide-to-hollow-waveguide transition circuit 1 illustrated in FIG. 1.

As illustrated in FIGS. 1 to 3, the coaxial-waveguide-to-hollow-waveguide transition circuit 1 includes a hollow waveguide 10 having an input/output end 11 used for inputting or outputting a high-frequency signal, a coaxial waveguide 20 having an end coupled to the hollow waveguide 10, and a strip conductor 30 which is a strip line located in the internal path 10*h* of the hollow waveguide 10. The coaxial-waveguide-to-hollow-waveguide transition circuit 1 has a function of converting a transmission mode mutually between the hollow waveguide 10 and the coaxial waveguide 20 of a high-frequency signal of a predetermined available frequency band such as the VHF band, the UHF band, the millimeter wave band, and the microwave band as well as a function of converting a characteristic impedance mutually between the hollow waveguide 10 and the coaxial waveguide 20. For example, the coaxial-waveguide-to-hollow-waveguide transition circuit 1 is capable of converting a transmission mode from one of a transverse electromagnetic (TEM) mode that is a transmission mode of the coaxial waveguide 20 and a transverse electric (TE) mode that is a transmission mode of the hollow waveguide 10, into the other.

As illustrated in FIG. 2, the hollow waveguide 10 is a rectangular waveguide made from metal which has a rectangular cross section on a plane (Y-Z plane that contains the Y-axis and Z-axis) perpendicular to a waveguide-axis direction (X-axis direction) of the hollow waveguide 10. The hollow waveguide 10 has a thickness of about several millimeters, for example. As illustrated in FIG. 3, the internal path 10*h* of the hollow waveguide 10 extends along the waveguide-axis direction.

The hollow waveguide 10 has a pair of narrow walls 13 and 14 forming short sides of the rectangular cross section and a pair of wide walls 15 and 16 forming long sides of the rectangular cross section. The narrow walls 13 and 14 and the wide walls 15 and 16 are inner walls extending along the waveguide-axis direction and form the internal path 10*h* of the hollow waveguide 10. The narrow walls 13 and 14 are E-planes parallel to the electric field, and the wide walls 15 and 16 are H-planes parallel to the magnetic field. An inner diameter D1, which is the distance between the wide walls 15 and 16 of the hollow waveguide 10, is, for example, several millimeters to several hundred millimeters. Furthermore, the hollow waveguide 10 has a terminal end in a closed state at one end of the hollow waveguide 10 in the positive direction of the X-axis, and a short-circuit surface 12 is provided on a termination surface which is an internal wall of the terminal end. An input/output end 11 is provided at an end of the hollow waveguide 10 on the negative side of the X-axis direction.

Note that because the cross-sectional shape of the internal path 10*h* of the hollow waveguide 10 is rectangular, the four corners of the rectangular shape have right angles in which the two long sides and the two short sides are orthogonal to each other at 90 degrees. As will be described later, instead of the hollow waveguide 10 having such right angle corners, a hollow waveguide having curved corners such as arc shapes or partially oval shapes having a constant curvature may be used.

Next, as illustrated in FIGS. 2 and 3, the coaxial waveguide 20 is located outside the hollow waveguide 10, has an input/output end 21 on the end surface on the negative side of the Z-axis direction, and has an end physically coupled to the wide wall 16 of the hollow waveguide 10 on the positive side of the Z-axis direction. In addition, the coaxial waveguide 20 includes a conducting core wire 22 such as a copper wire that functions as a signal line, a ring-shaped outer conductor 24 concentrically surrounding the conducting core wire 22, and an electrically insulative dielectric 23 which is interposed between the conducting core wire 22 and the outer conductor 24. An end 22*p* (hereinafter also referred to as "insertion end 22*p*") of the conducting core wire 22 is inserted into the internal path 10*h* and located so as to protrude from the end of the coaxial waveguide 20 in the positive direction of the Z-axis.

Next, as illustrated in FIGS. 1 to 3, the strip conductor 30 is a member in the form of a plate made from metal and located so as to extend in the waveguide-axis direction (X-axis direction) in the internal path 10*h* of the hollow waveguide 10. In order to make a short-circuit connection between the short-circuit surface 12 and the insertion end 22*p* of the conducting core wire 22 protruding into the internal path 10*h*, the strip conductor 30 has a connection end (first connection end) 31 connected to the tip of the insertion end 22*p* and a connection end (second connection end) 32 connected to the short-circuit surface 12 of the hollow waveguide 10 while in contact therewith. The connection end 31 of the strip conductor 30 is only required to be connected to the tip of the insertion end 22*p* using a conductive adhesive agent such as solder. The connection end 31 and the insertion end 22*p* form a probe of the coaxial-waveguide-to-hollow-waveguide transition circuit 1.

In addition, the strip conductor 30 has a front surface facing the wide wall 15 and a rear surface facing the other wide wall 16. The front surface and the rear surface are arranged so as to be parallel to the wide walls 15 and 16, respectively. That is, the front surface and the rear surface of the strip conductor 30 are parallel to the X-Y plane that contains the X-axis and the Y-axis. Furthermore, the thickness of the strip conductor 30 is thinner than the inner diameter D1 between the wide walls 15 and 16. Specifically, the thickness may be, for example, less than or equal to one fifth of the inner diameter D1. Because the strip conductor 30 has such location and thickness, disturbance of the electric field distribution in the internal path 10*h* can be suppressed.

The length L1 of the strip conductor 30 between the center of the connection end 31 forming the probe and a contact surface of the connection end 32 with respect to the short-circuit surface 12 is designed to be approximately equal to an odd multiple of one quarter ($=\lambda_g/4$) of a wavelength (wavelength on the transmission line) $\lambda_g$ of a high-frequency signal in the strip conductor 30.

Next, the operation of the coaxial-waveguide-to-hollow-waveguide transition circuit 1 will be described. Hereinafter, let us consider a case where high-frequency power is input to the input/output end 21 of the coaxial waveguide 20 and high-frequency power after conversion is output from the input/output end 11 of the hollow waveguide 10.

Figure 4:
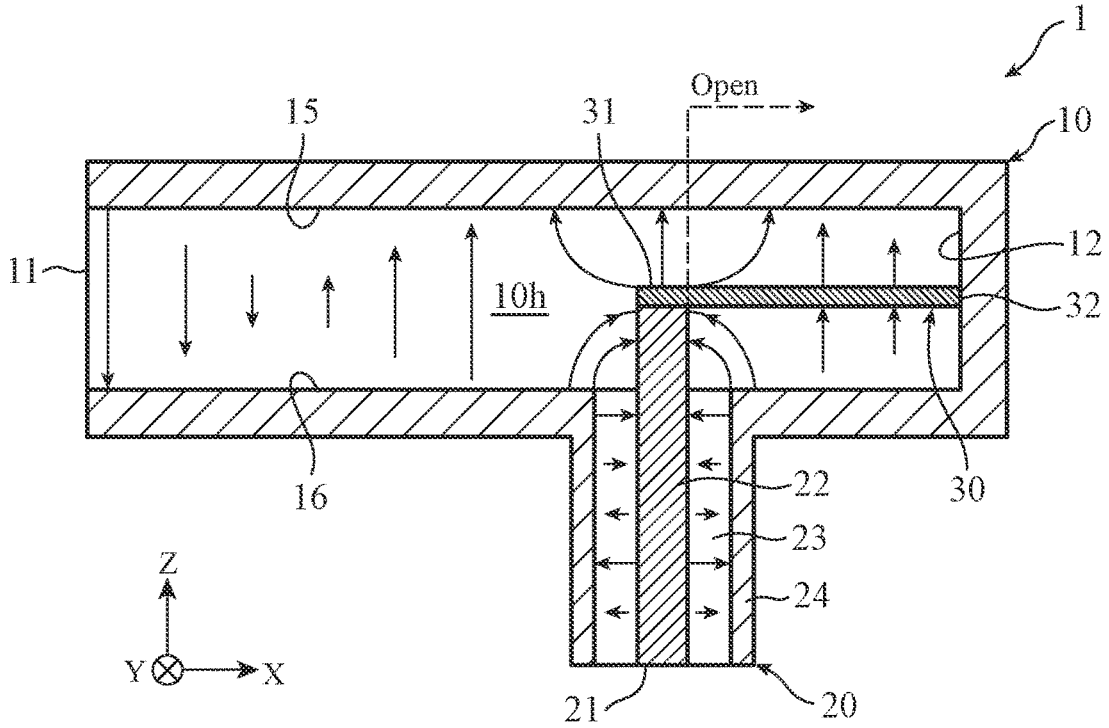
FIG. 4 is a schematic cross-sectional view illustrating an exemplary electric field distribution in the coaxial-waveguide-to-hollow-waveguide transition circuit of the first embodiment.

FIG. 4 is a schematic cross-sectional view illustrating an exemplary electric field distribution in the coaxial-waveguide-to-hollow-waveguide transition circuit 1. In FIG. 4, directions of the electric field are indicated by arrows. As illustrated in FIG. 4, an electric field distribution directed from the connection end 31 forming the probe toward the wide wall 15 of the hollow waveguide 10 and an electric field distribution directed from the wide wall 16 toward the vicinity of the connection end 31 are generated. Because such electric field distributions coincide with an electric field distribution in a $TE_{10}$ mode propagated through the hollow waveguide 10, a high-frequency signal propagated in a coaxial waveguide 20 in a coaxial mode can be coupled to the $TE_{10}$ mode of the hollow waveguide 10 in terms of the electric field near the probe.

Figure 5:
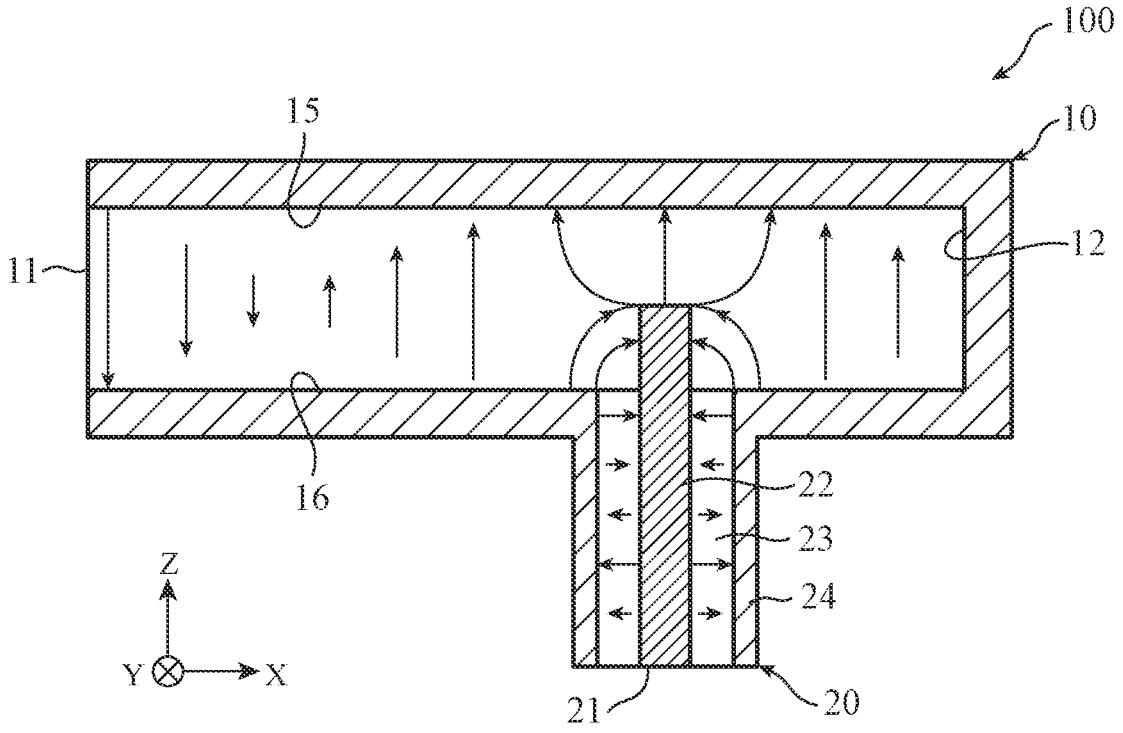
FIG. 5 is a schematic cross-sectional view illustrating an exemplary electric field distribution in a coaxial-waveguide-to-hollow-waveguide transition circuit of a comparative example.

On the other hand, FIG. 5 is a schematic cross-sectional view illustrating an exemplary electric field distribution in a coaxial-waveguide-to-hollow-waveguide transition circuit 100 having a hollow waveguide 10 from which the strip conductor 30 has been removed and a coaxial waveguide 20. Also in this coaxial-waveguide-to-hollow-waveguide transition circuit 100, an electric field distribution directed from a probe (insertion end 22*p*) of a conducting core wire 22 toward a wide wall 15 of the hollow waveguide 10 and an electric field distribution directed from the wide wall 16 toward the vicinity of the probe are generated. Such electric field distributions coincide with the electric field distribution of the $TE_{10}$ mode propagated through the hollow waveguide 10.

As illustrated in FIG. 4, the front surface and rear surface of the strip conductor 30 of the present embodiment are arranged so as to be parallel to the wide walls 15 and 16, respectively. In addition, the thickness of the strip conductor 30 is thinner than the inner diameter D1 of the hollow waveguide 10. Therefore, the present embodiment is capable of generating an electric field distribution substantially similar to the electric field distribution generated inside the coaxial-waveguide-to-hollow-waveguide transition circuit 100 of FIG. 5 in the internal path 10*h* of the hollow waveguide 10. In addition, the connection end 31 of the strip conductor 30 is short-circuited to the short-circuit surface 12 of the hollow waveguide 10. Therefore, the impedance when viewing the short-circuit surface 12 that is apart from the connection end 31 forming the probe by a distance of an odd multiple of $\lambda_g/4$ (corresponding to an electrical length of 90 degrees) is substantially infinite (open state). Therefore, it is possible to electrically create a state equivalent to a state in which the strip conductor 30 is not connected. Therefore, the strip conductor 30 electrically does not affect the electric field distribution inside the hollow waveguide 10 nor the impedance of the probe. Like in the case of the coaxial-waveguide-to-hollow-waveguide transition circuit 100 of FIG. 5, the coaxial-waveguide-to-hollow-waveguide transition circuit 1 of the present embodiment is capable of coupling a high-frequency signal propagated in a coaxial mode with a transmission mode (for example, the $TE_{10}$ mode) of the hollow waveguide 10 in terms of the electric field and outputting the high-frequency signal of the transmission mode from the input/output end 11 of the hollow waveguide 10. As a result, broad-band characteristics can be implemented.

In the case of the coaxial-waveguide-to-hollow-waveguide transition circuit 100 of FIG. 5, it is difficult to dissipate the heat generated at a tip portion of the conducting core wire 22 when high electric power is input to an input/output end 21 of the coaxial waveguide 20, and thus there is a possibility that the shape of the tip portion may be deformed by the heat, thus disadvantageously degrading the electrical characteristics of the coaxial-waveguide-to-hollow-waveguide transition circuit 100. In contrast, in the case of the coaxial-waveguide-to-hollow-waveguide transition circuit 1 of the first embodiment, even when high electric power is input to the input/output end 21 of the coaxial waveguide 20, the heat generated at the probe is transferred through the strip conductor 30, and dissipated through the wall of the hollow waveguide 10. Therefore, deformation of the probe due to the heat can be prevented. Therefore, electrical characteristics of the coaxial-waveguide-to-hollow-waveguide transition circuit 1 are not degraded, and good broad-band characteristics can be maintained.

As described above, the coaxial-waveguide-to-hollow-waveguide transition circuit 1 of the first embodiment has a structure that can maintain good broad-band characteristics without degrading electrical characteristics even when high electric power is input.

In addition as described above, the strip conductor 30 does not electrically affect the electric field distribution inside the hollow waveguide 10 nor the impedance of the probe. Only by adding this strip conductor 30 to the coaxial-waveguide-to-hollow-waveguide transition circuit 100 of FIG. 5, the coaxial-waveguide-to-hollow-waveguide transition circuit 1 of the present embodiment can be configured. At this time, because it is not necessary to change various physical dimensions of the coaxial-waveguide-to-hollow-waveguide transition circuit 100 of FIG. 5, the coaxial-waveguide-to-hollow-waveguide transition circuit 1 of the present embodiment has a configuration that is very easy to design.

Second Embodiment

Figure 6:
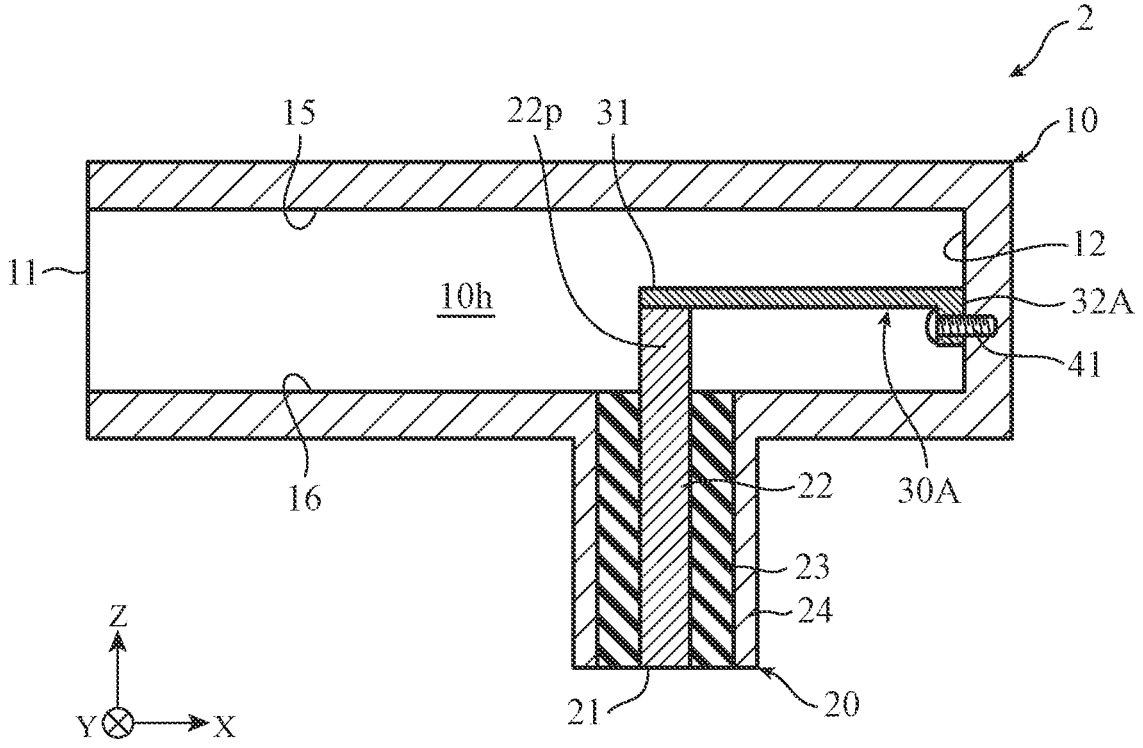
FIG. 6 is a schematic cross-sectional view of a coaxial-waveguide-to-hollow-waveguide transition circuit according to a second embodiment of the present invention.

FIG. 6 is a schematic cross-sectional view of a coaxial-waveguide-to-hollow-waveguide transition circuit 2 according to a second embodiment of the present invention. A configuration of the coaxial-waveguide-to-hollow-waveguide transition circuit 2 of the present embodiment is the same as that of the coaxial-waveguide-to-hollow-waveguide transition circuit 1 of the first embodiment except that the strip conductor 30 of the first embodiment is replaced by a strip conductor 30A and a fastening member 41 of FIG. 6.

In order to make a short-circuit connection between an insertion end 22*p* of a conducting core wire 22 and a short-circuit surface 12, the strip conductor 30A of this embodiment has a connection end (first connection end) 31 connected to a tip of the insertion end 22*p*, and a connection end (second connection end) 32A held to the short-circuit surface 12 of the hollow waveguide 10 by the fastening member 41. A configuration of the strip conductor 30A is the same as that of the strip conductor 30 of the first embodiment except for the shape of the connection end 32A.

As illustrated in FIG. 6, a shaft portion of the fastening member 41 is inserted through a through hole formed in the connection end 32A and screwed into an attachment hole formed on the short-circuit surface 12. Furthermore, the head of the fastening member 41 is pressed in the positive direction of the X-axis against a surface of the connection end 32A. Like in the case of the first embodiment, the length of the strip conductor 30A between the center of the connection end 31 forming a probe and a contact surface of the connection end 32A with respect to the short-circuit surface 12 is designed to be approximately equal to an odd multiple of one quarter ($=\lambda_g/4$) of a wavelength (wavelength on the transmission line) $\lambda_g$ of a high-frequency signal in the strip conductor 30A.

Also in the second embodiment, like in the first embodiment, good broad-band characteristics can be maintained without degrading electrical characteristics even when high electric power is input. In addition, the strip conductor 30A is held to the short-circuit surface 12 by using the fastening member 41. As a result, it is ensured that the strip conductor 30A comes into contact with the short-circuit surface 12, and thus degradation of characteristics due to manufacturing variations can be reduced.

Third Embodiment

Figure 7:
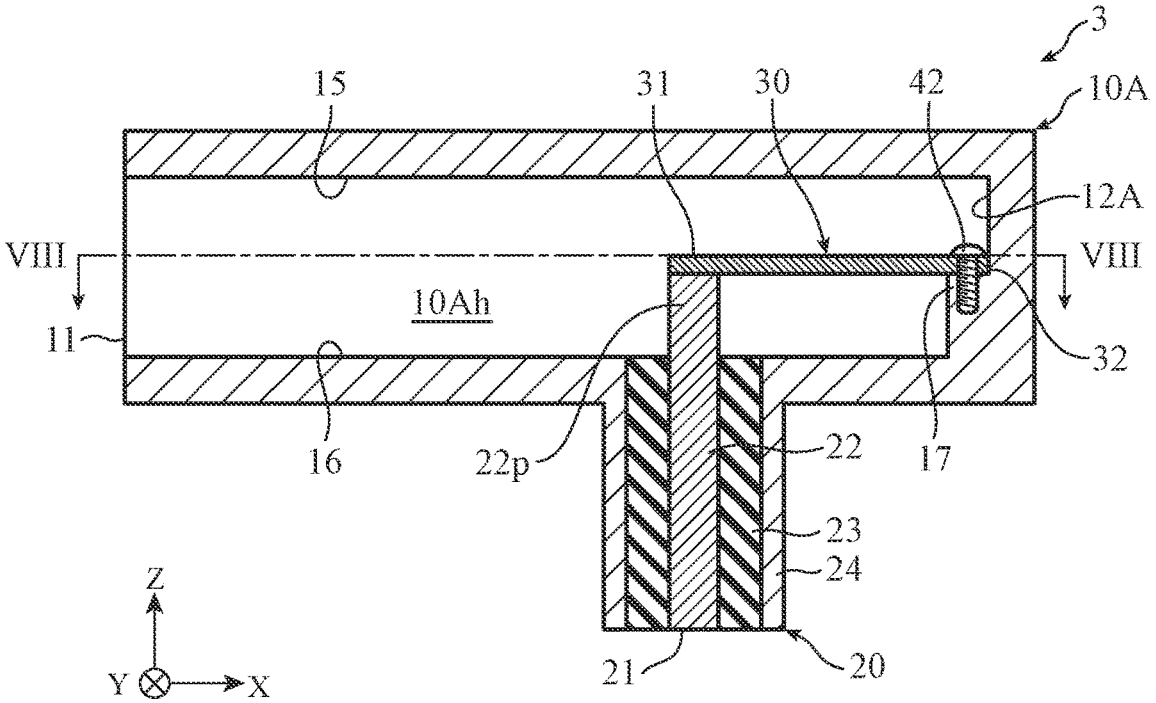
FIG. 7 is a schematic cross-sectional view of a coaxial-waveguide-to-hollow-waveguide transition circuit according to a third embodiment of the present invention.
Figure 8:
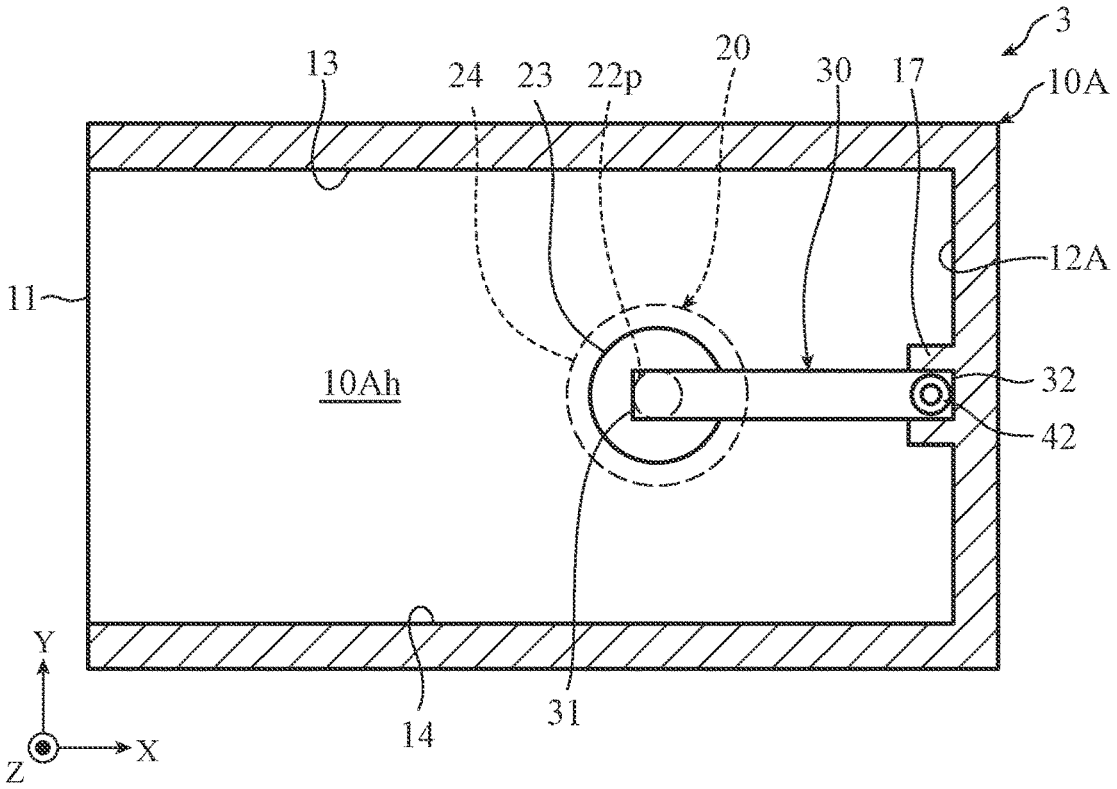
FIG. 8 is a schematic cross-sectional view taken along line VIII-VIII of the coaxial-waveguide-to-hollow-waveguide transition circuit 3 illustrated in FIG. 7.

FIG. 7 is a schematic cross-sectional view of a coaxial-waveguide-to-hollow-waveguide transition circuit 3 according to a third embodiment of the present invention. FIG. 8 is a schematic cross-sectional view taken along line VIII-VIII of the coaxial-waveguide-to-hollow-waveguide transition circuit 3 illustrated in FIG. 7. A configuration of the coaxial-waveguide-to-hollow-waveguide transition circuit 3 of the present embodiment is the same as that of the coaxial-waveguide-to-hollow-waveguide transition circuit 1 of the first embodiment except that the hollow waveguide 10 of the first embodiment is replaced by a hollow waveguide 10A and a fastening member 42 of FIG. 7.

As illustrated in FIGS. 7 and 8, the hollow waveguide 10A of the present embodiment has a terminal end in a closed state at one end in the positive direction of the X-axis, and a short-circuit surface 12A is provided on an internal wall (termination surface) of the terminal end. A part of the short-circuit surface 12A protrudes in the X-axis negative direction to form a mounting portion 17. A connection end 32 of the strip conductor 30 is held to the mounting portion 17 by the fastening member 42. A structure of the hollow waveguide 10A is the same as that of the hollow waveguide 10 of the first embodiment except that the short-circuit surface 12 of FIG. 3 is replaced by a short-circuit surface 12A of FIG. 7. Like in the case of the first embodiment, the strip conductor 30 is located in the internal path 10Ah of the hollow waveguide 10A.

As illustrated in FIGS. 7 and 8, a shaft portion of the fastening member 42 is inserted through a through hole formed in the connection end 32 of the strip conductor 30 and screwed into an attachment hole formed in the mounting portion 17. Furthermore, the head of the fastening member 42 is pressed in the Z-axis negative direction against a front surface of the strip conductor 30. Like in the case of the first embodiment, the length of the strip conductor 30 between the center of a connection end 31 forming a probe and a contact surface of the connection end 32 with respect to the short-circuit surface 12A is designed to be approximately equal to an odd multiple of one quarter ($=\lambda_g/4$) of a wavelength (wavelength on the transmission line) $\lambda_g$ of a high-frequency signal in the strip conductor 30.

Also in the third embodiment, like in the first embodiment, good broad-band characteristics can be maintained without degrading electrical characteristics even when high electric power is input. In addition, the strip conductor 30 is held to the short-circuit surface 12A by using the fastening member 42. As a result, it is ensured that the strip conductor 30 comes into contact with the short-circuit surface 12A, and thus degradation of characteristics due to manufacturing variations can be reduced.

Fourth Embodiment

Figure 9:
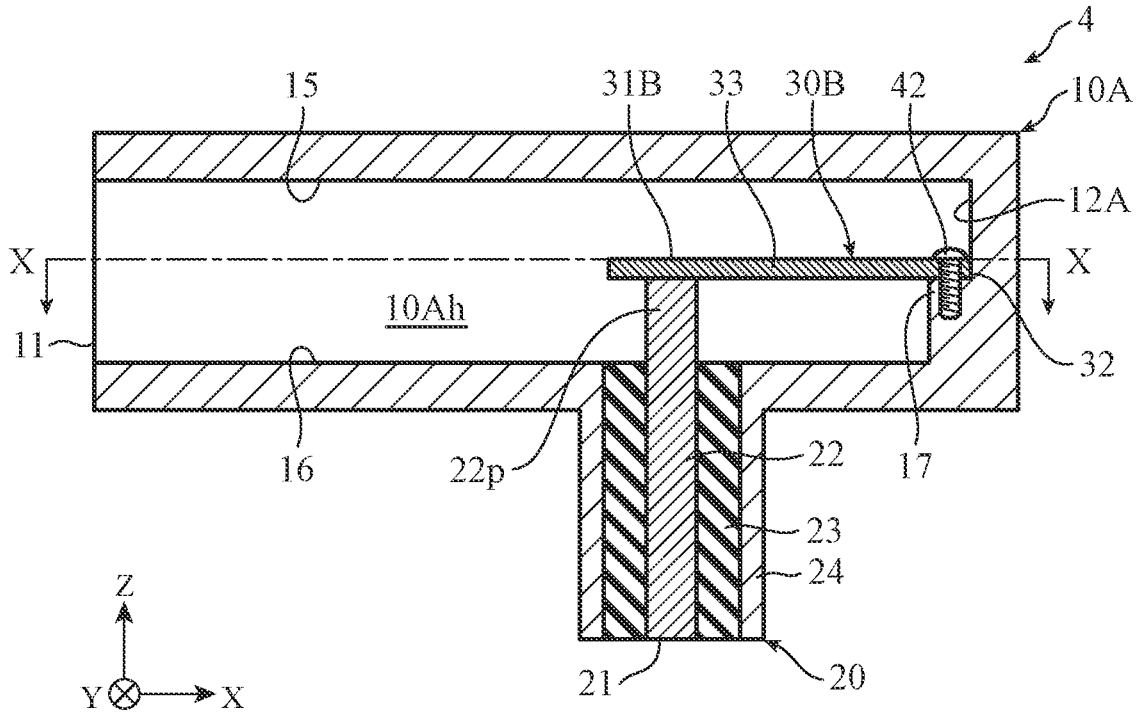
FIG. 9 is a schematic cross-sectional view of a coaxial-waveguide-to-hollow-waveguide transition circuit according to a fourth embodiment of the present invention.
Figure 10:
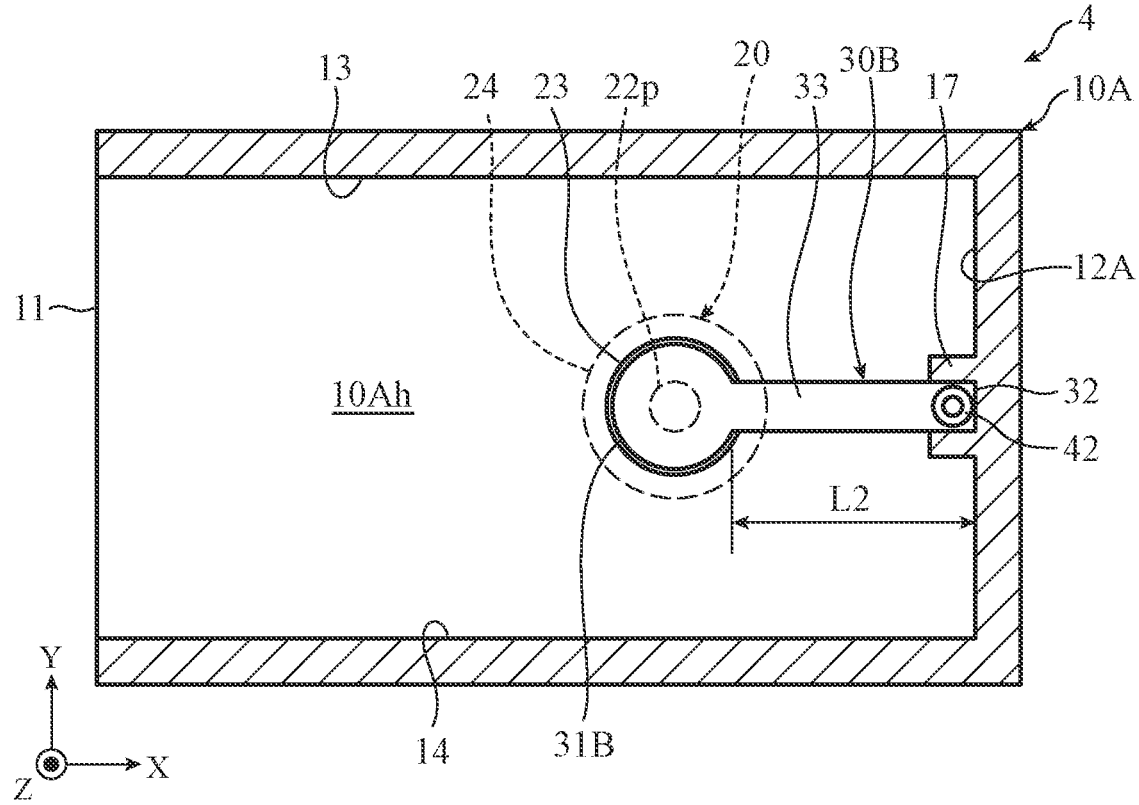
FIG. 10 is a schematic cross-sectional view taken along line X-X of the coaxial-waveguide-to-hollow-waveguide transition circuit illustrated in FIG. 9.

FIG. 9 is a schematic cross-sectional view of a coaxial-waveguide-to-hollow-waveguide transition circuit 4 according to a fourth embodiment of the present invention. Also, FIG. 10 is a schematic cross-sectional view taken along line X-X of the coaxial-waveguide-to-hollow-waveguide transition circuit 4 illustrated in FIG. 9. A configuration of the coaxial-waveguide-to-hollow-waveguide transition circuit 4 of the present embodiment is the same as that of the coaxial-waveguide-to-hollow-waveguide transition circuit 3 of the third embodiment except that the strip conductor 30 of the third embodiment (FIGS. 7 and 8) is replaced by a strip conductor 30B of FIG. 9.

In order to a short-circuit connection between a short-circuit surface 12A and an insertion end 22*p* of a conducting core wire 22, the strip conductor 30B of this embodiment has a connection end (first connection end) 31B connected to a tip of the insertion end 22*p*, a connection end (second connection end) 32 held to the short-circuit surface 12A of the hollow waveguide 10 by a fastening member 42, and a linear line portion 33 physically connecting the connection ends 31B and 32. A configuration of the strip conductor 30B is the same as that of the strip conductor 30 of the first embodiment except for the connection end 31B forming a probe. The connection end 31B is only required to be connected to the tip of the insertion end 22*p* using a conductive adhesive agent such as solder. The connection end 31B and the insertion end 22*p* form a probe of the coaxial-waveguide-to-hollow-waveguide transition circuit 4.

As illustrated in FIG. 10, the length L2 of the strip conductor 30B between the connection end 31B forming the probe and a contact surface of the connection end 32 with respect to the short-circuit surface 12A (that is, the length of the line portion 33) is designed to be approximately equal to an odd multiple of one quarter ($=\lambda_g/4$) of a wavelength (wavelength on the transmission line) $\lambda_g$ of a high-frequency signal in the strip conductor 30B. Therefore, like in the case of the first embodiment, the impedance when viewing the short-circuit surface 12A from the connection end 31B is substantially infinite (open state). Therefore, it is possible to electrically create a state equivalent to a state in which the strip conductor 30B is not connected.

Furthermore, as illustrated in FIG. 10, the outer dimension of the connection end 31B forming the probe when viewed from the Z-axis direction is larger than the outer dimension of the connection end 32 connected to the short-circuit surface 12A. Meanwhile in the first and third embodiments as illustrated in FIG. 8, the outer dimension of the connection end 31 is substantially the same as the outer dimension of the insertion end 22*p* of the conducting core wire 22. On the other hand, as illustrated in FIG. 10, the outer dimension of the connection end 31B of the present embodiment is clearly larger than the outer dimension of the insertion end 22*p* of the conducting core wire 22. By using the connection end 31B having a large outer dimension as described above, the dimension of the tip portion of the probe when viewed from the Z-axis direction is increased. As a result, it is possible to implement broader band electrical characteristics.

As described above, also in the fourth embodiment like in the first embodiment, good broad-band characteristics can be maintained without degrading electrical characteristics even when high electric power is input. Furthermore, as compared with the first to third embodiments, it is possible to implement broader band electrical characteristics.

Fifth Embodiment

In the first embodiment as illustrated in FIG. 3, the end of the strip conductor 30 is connected to the termination surface of the hollow waveguide 10. A strip conductor connected to at least one of the narrow walls 13 and 14 of the hollow waveguide 10 may be used instead of the strip conductor 30 connected to the termination surface in this manner. A fifth embodiment having such a strip conductor will be described below.

Figure 11:
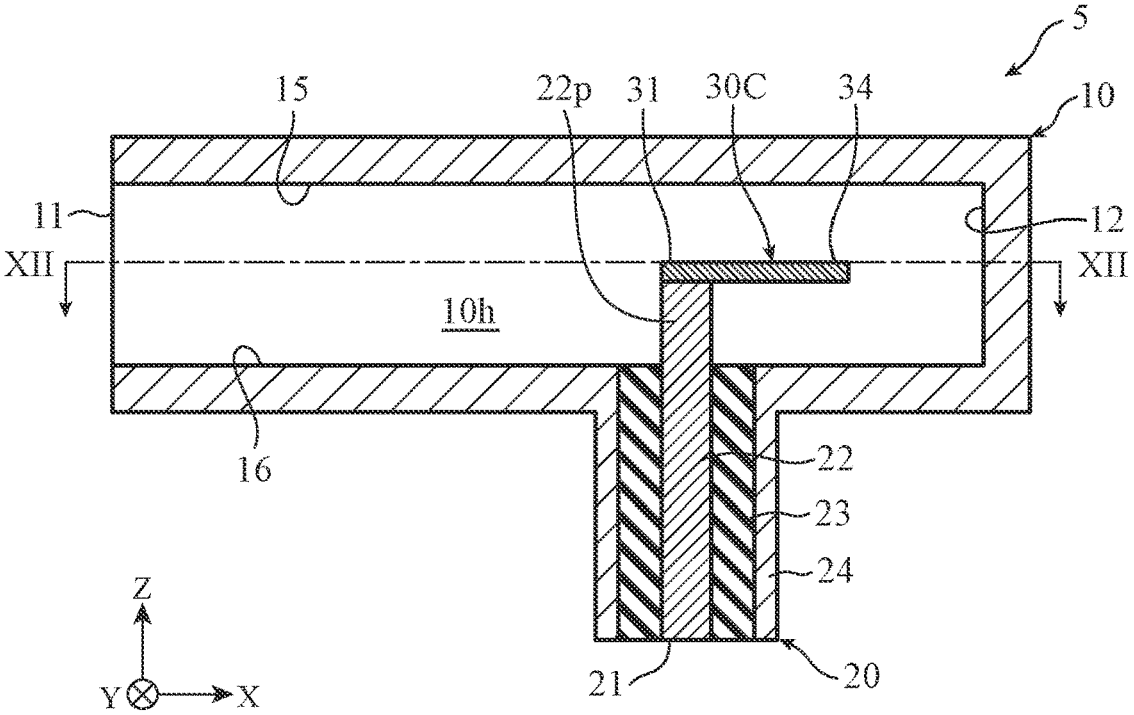
FIG. 11 is a schematic cross-sectional view of a coaxial-waveguide-to-hollow-waveguide transition circuit according to a fifth embodiment of the present invention.
Figure 12:
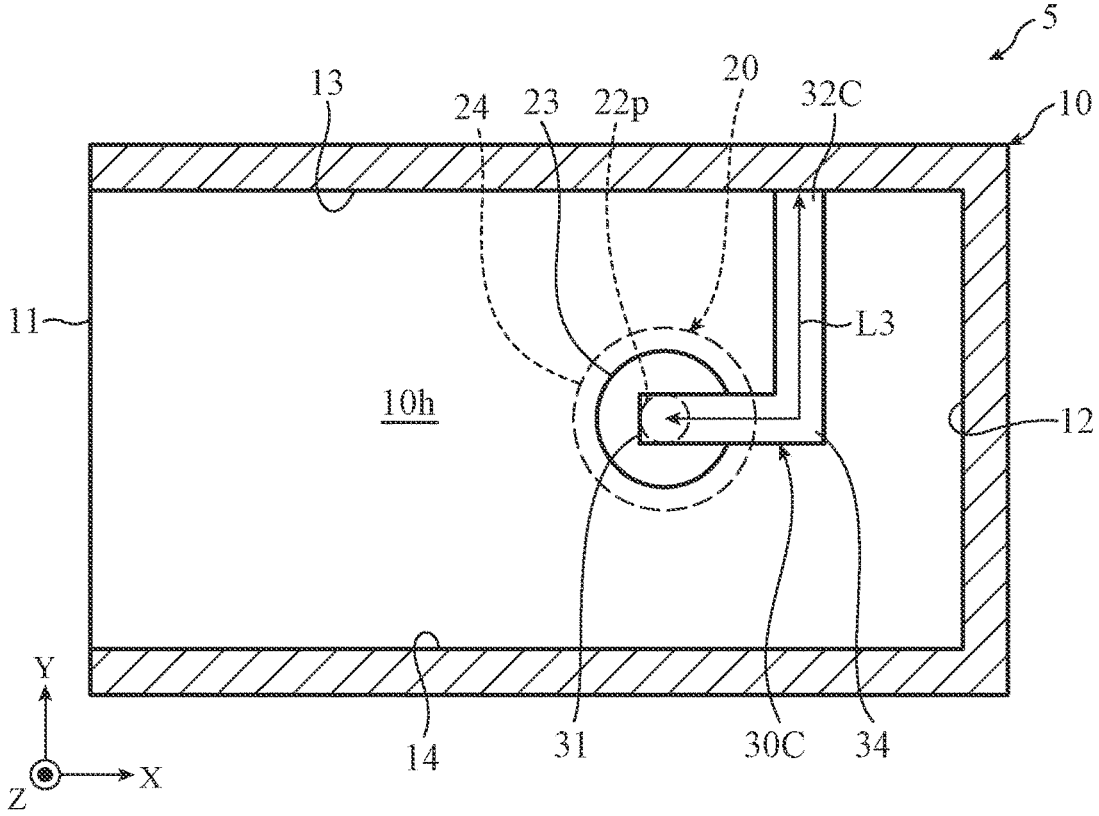
FIG. 12 is a schematic cross-sectional view taken along line XII-XII of the coaxial-waveguide-to-hollow-waveguide transition circuit illustrated in FIG. 11.

FIG. 11 is a schematic cross-sectional view of a coaxial-waveguide-to-hollow-waveguide transition circuit 5 according to the fifth embodiment of the present invention. In addition, FIG. 12 is a schematic cross-sectional view taken along line XII-XII of the coaxial-waveguide-to-hollow-waveguide transition circuit 5 illustrated in FIG. 11. A configuration of the coaxial-waveguide-to-hollow-waveguide transition circuit 5 of the present embodiment is the same as that of the coaxial-waveguide-to-hollow-waveguide transition circuit 1 of the first embodiment except that the strip conductor 30 of the first embodiment is replaced by a strip conductor 30C illustrated in FIGS. 11 and 12.

As illustrated in FIGS. 11 and 12, the strip conductor 30C of the present embodiment is a member in the form of a plate made from metal and, in order to make a short-circuit connection between a narrow wall 13 and an insertion end 22*p* of a conducting core wire 22, has a connection end (first connection end) 31 connected to a tip of the insertion end 22*p*, a connection end (second connection end) 32C connected to the narrow wall 13 of the hollow waveguide 10 while in contact therewith, and a bent portion (bended portion) 34 which is a strip line that physically connecting the connection ends 31 and 32C. The bent portion 34 includes a portion extending in the X-axis direction and a portion extending along the Y-axis direction. The connection end 31 of the strip conductor 30C is only required to be connected to the tip of the insertion end 22*p* using a conductive adhesive agent such as solder. The connection end 31 and the insertion end 22*p* form a probe of the coaxial-waveguide-to-hollow-waveguide transition circuit 5.

Like the strip conductor 30 of the first embodiment, the strip conductor 30C has a front surface facing a wide wall 15 and a rear surface facing the other wide wall 16. The front surface and the rear surface are arranged so as to be parallel to the wide walls 15 and 16, respectively. Furthermore, the thickness of the strip conductor 30C is the same as that of the strip conductor 30 of the first embodiment. Because the strip conductor 30C has such location and thickness, disturbance of the electric field distribution in the internal path 10*h* can be suppressed.

Furthermore as illustrated in FIG. 12, the length L3 of the strip conductor 30C between the center of the connection end 31 forming the probe and a contact surface of the connection end 32C with respect to the narrow wall 13 is designed to be approximately equal to an odd multiple of one quarter ($=\lambda_g/4$) of a wavelength (wavelength on the transmission line) $\lambda_g$ of a high-frequency signal in the strip conductor 30C. Therefore, like in the case of the first embodiment, the impedance when viewing the narrow wall 13 from the connection end 31 is substantially infinite (open state). Therefore, it is possible to electrically create a state equivalent to a state in which the strip conductor 30C is not connected. Therefore, the strip conductor 30C electrically does not affect the electric field distribution inside the hollow waveguide 10 nor the impedance of the probe. The coaxial-waveguide-to-hollow-waveguide transition circuit 5 according to the present embodiment is capable of coupling a high-frequency signal propagated in a coaxial mode with a transmission mode of the hollow waveguide 10 in terms of the electric field and outputting the high-frequency signal of the transmission mode from an input/output end 11 of the hollow waveguide 10. As a result, broad-band characteristics can be implemented.

Moreover, even when high electric power is input to the input/output end 21 of the coaxial waveguide 20, the heat generated at the probe is transferred through the strip conductor 30C and dissipated through the narrow wall 13 of the hollow waveguide 10. Therefore, the probe is not deformed by heat. Therefore, electrical characteristics of the coaxial-waveguide-to-hollow-waveguide transition circuit 5 is not degraded, and good broad-band characteristics can be maintained.

As described above, the coaxial-waveguide-to-hollow-waveguide transition circuit 5 of the fifth embodiment has a structure that can maintain good broad-band characteristics without degrading electrical characteristics even when high electric power is input.

Note that the configuration of the present embodiment may be modified such that the end of the strip conductor is held to the narrow wall 13 using the fastening member 41 or 42 as in the second embodiment (FIG. 6) or the third embodiment (FIGS. 7 and 8). Furthermore, instead of the connection end 31 of the present embodiment, the connection end 31B (FIGS. 9 and 10) of the fourth embodiment may be used.

Sixth Embodiment

In the fifth embodiment, the strip conductor 30C is connected with the narrow wall 13 at one position, although no limitation thereto is intended. In order to improve the heat radiation performance, the configuration of the strip conductor 30C may be modified so as to be connected to the narrow walls 13 and 14 of the hollow waveguide 10 at a plurality of positions. As a result, a coaxial-waveguide-to-hollow-waveguide transition circuit having high durability against high electric power can be obtained.

Figure 13:
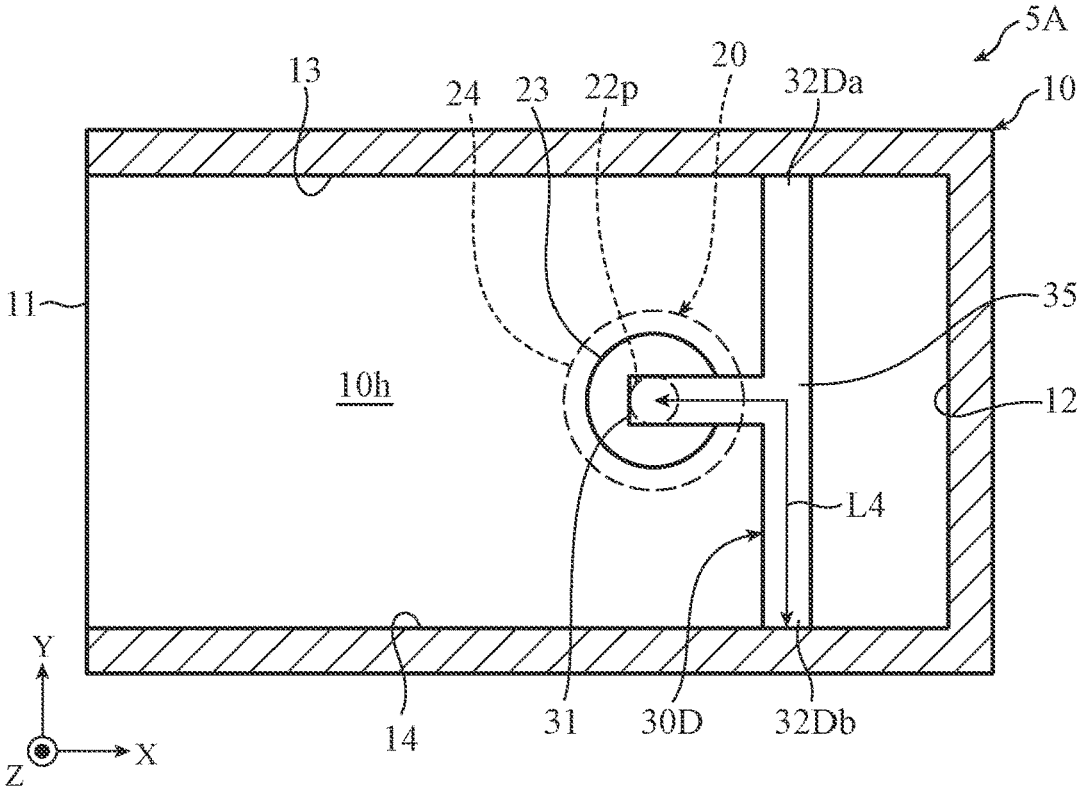
FIG. 13 is a schematic cross-sectional view illustrating a configuration of a coaxial-waveguide-to-hollow-waveguide transition circuit according to a sixth embodiment of the present invention.

FIG. 13 is a schematic cross-sectional view illustrating a configuration of a coaxial-waveguide-to-hollow-waveguide transition circuit 5A according to a sixth embodiment of the present invention. A configuration of the coaxial-waveguide-to-hollow-waveguide transition circuit 5A is the same as that of the coaxial-waveguide-to-hollow-waveguide transition circuit 5 of the fifth embodiment except that the strip conductor 30C of FIG. 12 is replaced by a strip conductor 30D of FIG. 13.

In order to short-circuit an insertion end 22*p* of a conducting core wire 22 to narrow walls 13 and 14, the strip conductor 30D of the present embodiment has a connection end (first connection end) 31 connected to the tip of the insertion end 22*p*, a connection end 32Da connected to the narrow wall 13 while in contact therewith, a connection end 32Db connected to the other narrow wall 14 while in contact therewith, and a branch line portion 35 which is a T-shaped strip line that physically connects the connection ends 31, 32Da and 32Db. The connection end 31 and the insertion end 22*p* form a probe of the coaxial-waveguide-to-hollow-waveguide transition circuit 5A.

Like the strip conductor 30 of the first embodiment, the strip conductor 30D has a front surface and a rear surface facing toward the wide walls 15 and 16, respectively, and the front surface and the rear surface are arranged so as to be parallel to the wide walls 15 and 16, respectively. The thickness of the strip conductor 30D is the same as that of the strip conductor 30 of the first embodiment. Because the strip conductor 30D has such location and thickness, disturbance of the electric field distribution in the internal path 10*h* can be suppressed.

Furthermore as illustrated in FIG. 13, the length L4 of the strip conductor 30D between the center of the connection end 31 forming the probe and a contact surface of the connection end 32Db with respect to the narrow wall 14 is designed to be approximately equal to an odd multiple of one quarter ($=\lambda_g/4$) of a wavelength (wavelength on the transmission line) $\lambda_g$ of a high-frequency signal in the strip conductor 30D. The length of the strip conductor 30D between the center of the connection end 31 and the contact surface of the connection end 32Da with respect to the narrow wall 13 is also equal to the length L4. Therefore, like in the case of the first embodiment, the impedance when viewing the narrow walls 13 and 14 from the connection end 31 is substantially infinite (open state). Therefore, it is possible to electrically create a state equivalent to a state in which the strip conductor 30D is not connected. The coaxial-waveguide-to-hollow-waveguide transition circuit 5A according to the present embodiment is capable of coupling a high-frequency signal propagated in a coaxial mode with a transmission mode of the hollow waveguide 10 in terms of the electric field and outputting the high-frequency signal of the transmission mode from an input/output end 11 of the hollow waveguide 10. As a result, broad-band characteristics can be implemented.

Moreover, even when high electric power is input, the heat generated at the probe is transferred through the strip conductor 30D and dissipated through the narrow walls 13 and 14 of the hollow waveguide 10. Therefore, deformation of the probe due to the heat can be prevented. Therefore, electrical characteristics of the coaxial-waveguide-to-hollow-waveguide transition circuit 5A is not degraded, and good broad-band characteristics can be maintained.

Figure 14:
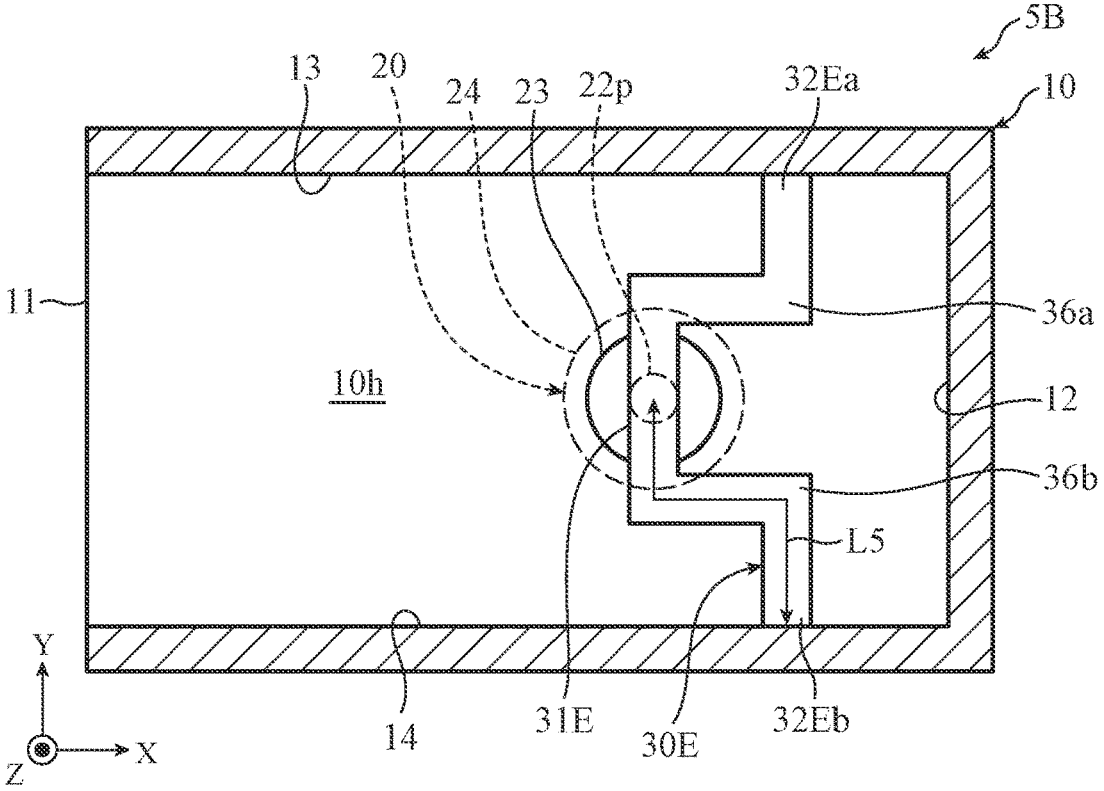
FIG. 14 is a schematic cross-sectional view illustrating a configuration of a coaxial-waveguide-to-hollow-waveguide transition circuit which is a modification of the sixth embodiment.

FIG. 14 is a schematic cross-sectional view illustrating a configuration of the coaxial-waveguide-to-hollow-waveguide transition circuit 5B which is a modification of the sixth embodiment. A configuration of the coaxial-waveguide-to-hollow-waveguide transition circuit 5B is the same as that of the coaxial-waveguide-to-hollow-waveguide transition circuit 5A of the sixth embodiment except that a strip conductor 30E having a shape different from that of the strip conductor 30D of FIG. 13 is included.

As illustrated in FIG. 14, the strip conductor 30E has a connection end (first connection end) 31E connected to a tip of an insertion end 22*p* of a conducting core wire 22, a connection end 32Ea connected to a narrow wall 13 while in contact therewith, a connection end 32Eb connected to the other narrow wall 14 while in contact therewith, a bended portion 36*a* physically connecting the connection end 31E and the connection end 32Ea, and a bended portion 36*b* physically connecting the connection end 31E and the other connection end 32Eb. As illustrated in FIG. 14, the length L5 of the strip conductor 30E between the center of the connection end 31E forming a probe and a contact surface of the connection end 32Eb with respect to the narrow wall 14 is designed to be approximately equal to an odd multiple of one quarter ($=\lambda_g/4$) of a wavelength (wavelength on the transmission line) $\lambda_g$ of a high-frequency signal in the strip conductor 30E. Similarly, the length of the strip conductor 30E between the center of the connection end 31E and the contact surface of the connection end 32Ea with respect to the narrow wall 13 is equal to the length L5. The coaxial-waveguide-to-hollow-waveguide transition circuit 5B as described above can also achieve similar effects to those of the sixth embodiment.

Note that the configuration of the present embodiment may be modified such that the multiple ends of the strip conductor are held to the narrow wall 13 or 14 using the fastening member 41 or 42 as in the second embodiment (FIG. 6) or the third embodiment (FIGS. 7 and 8). Furthermore, instead of the connection end 31E of the present embodiment, the connection end 31B (FIGS. 9 and 10) of the fourth embodiment may be used.

Seventh Embodiment

In each of the first to sixth embodiments, the number of coaxial waveguides coupled to a hollow waveguide is one, although no limitation thereto is intended. Hereinafter, a coaxial-waveguide-to-hollow-waveguide transition circuit 6 of a seventh embodiment having two coaxial waveguides will be described.

Figure 15:
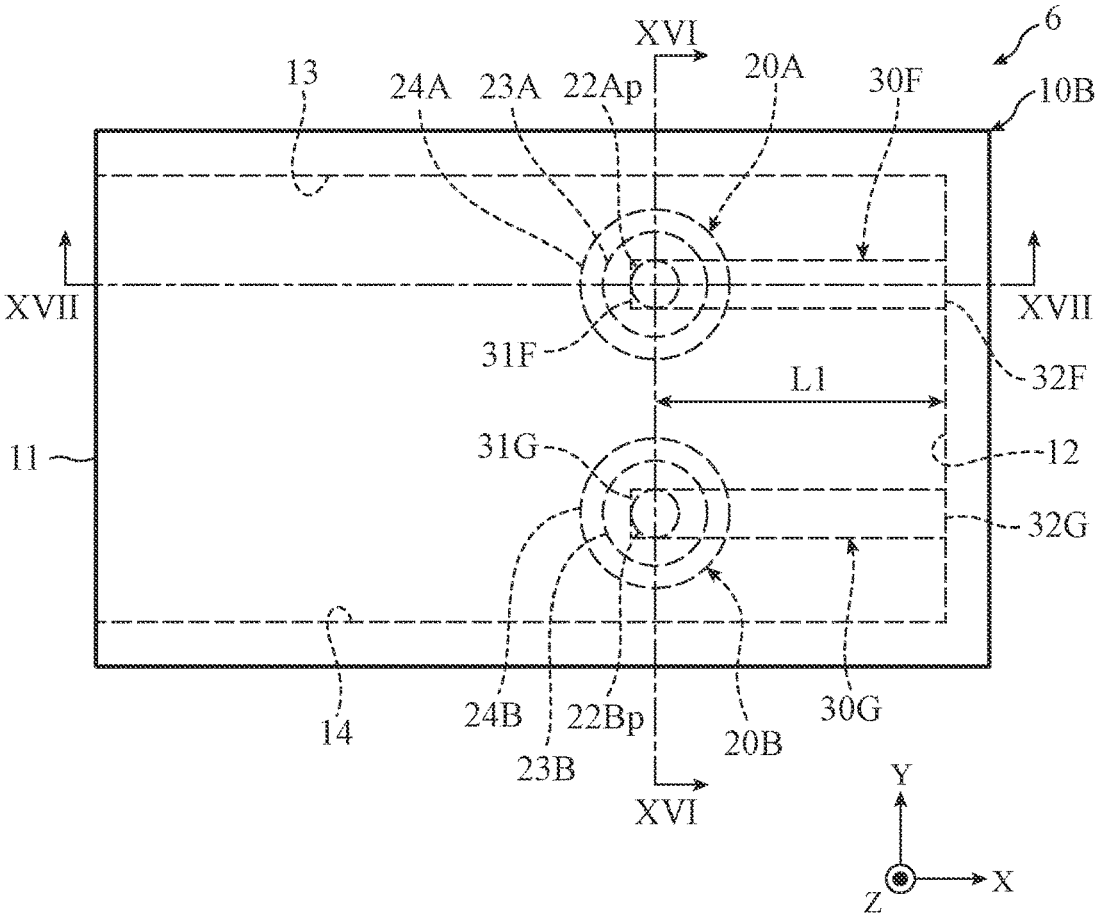
FIG. 15 is a top view illustrating a schematic configuration of a coaxial-waveguide-to-hollow-waveguide transition circuit according to a seventh embodiment of the present invention.
Figure 16:
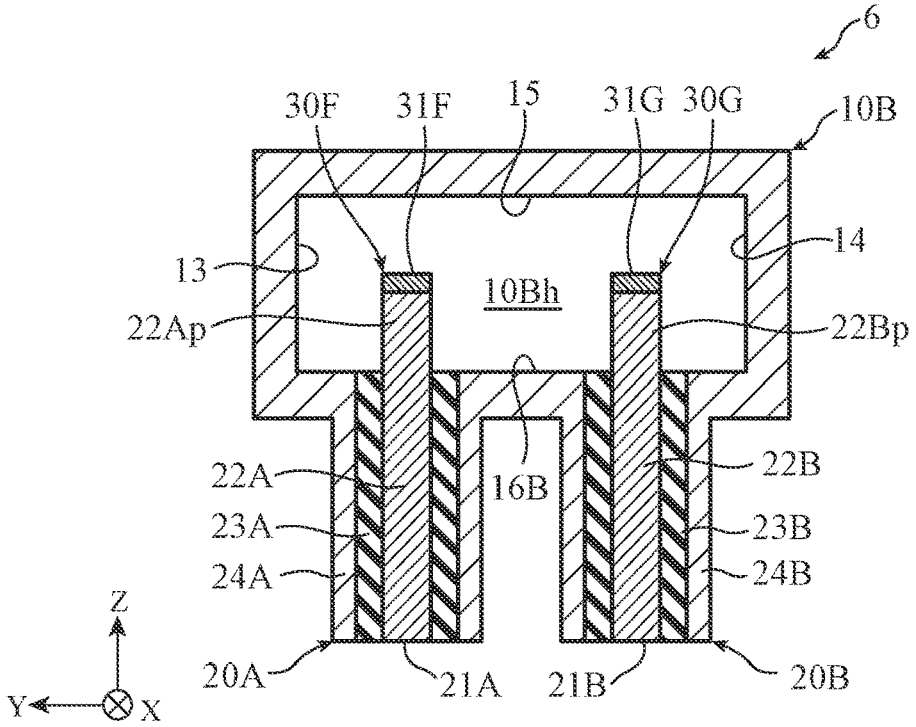
FIG. 16 is a schematic cross-sectional view taken along line XVI-XVI of the coaxial-waveguide-to-hollow-waveguide transition circuit illustrated in FIG. 15.
Figure 17:
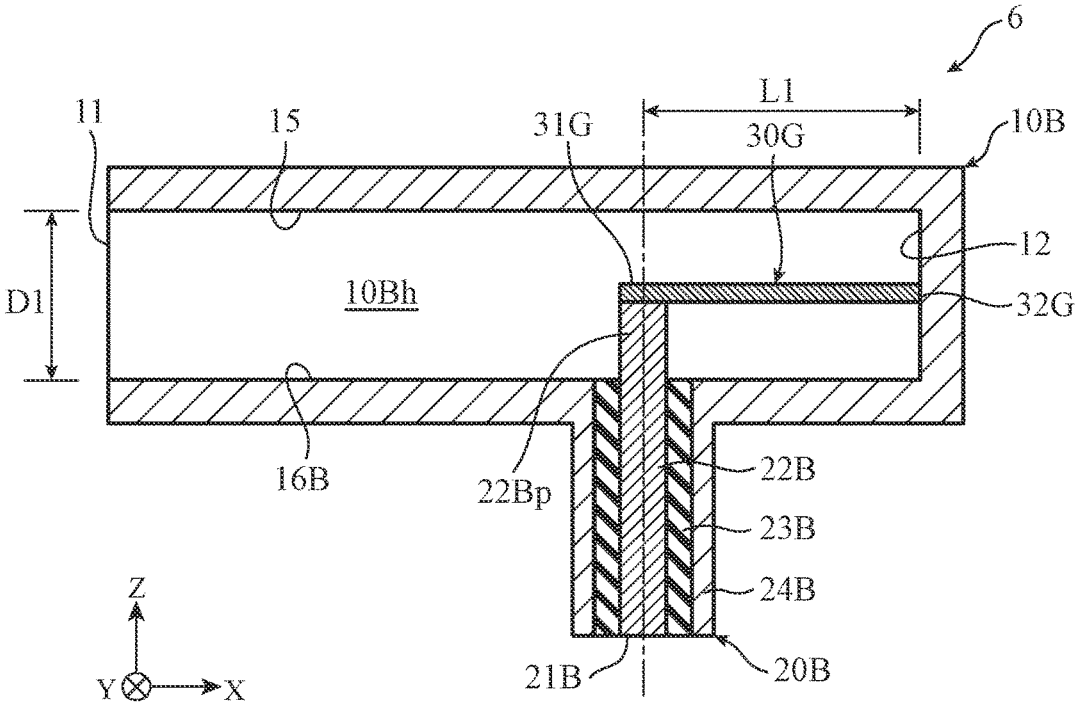
FIG. 17 is a schematic cross-sectional view taken along line XVII-XVII of the coaxial-waveguide-to-hollow-waveguide transition circuit illustrated in FIG. 15.

FIG. 15 is a top view illustrating a schematic configuration of a coaxial-waveguide-to-hollow-waveguide transition circuit 6 according to the seventh embodiment of the present invention. FIG. 16 is a schematic cross-sectional view taken along line XVI-XVI of the coaxial-waveguide-to-hollow-waveguide transition circuit 6 illustrated in FIG. 15. FIG. 17 is a schematic cross-sectional view taken along line XVII-XVII of the coaxial-waveguide-to-hollow-waveguide transition circuit 6 illustrated in FIG. 15.

As illustrated in FIGS. 15 to 17, the coaxial-waveguide-to-hollow-waveguide transition circuit 6 includes a hollow waveguide 10B having an input/output end 11 used for inputting or outputting a high-frequency signal, two coaxial waveguides 20A and 20B each having an end coupled to the hollow waveguide 10B, and strip conductors 30F and 30G which are two strip lines arranged in parallel in the internal path 10Bh of the hollow waveguide 10B. The coaxial-waveguide-to-hollow-waveguide transition circuit 6 has a function of converting a transmission mode mutually between the hollow waveguide 10B and the coaxial waveguides 20A and 20B of a high-frequency signal of a predetermined available frequency band as well as a function of converting a characteristic impedance mutually between the hollow waveguide 10B and the coaxial waveguides 20A and 20B.

Furthermore, the coaxial waveguides 20A and 208 have input/output ends 21A and 21B, respectively. The coaxial-waveguide-to-hollow-waveguide transition circuit 6 has a function as a power combiner that combines the powers of high-frequency signals input to the input/output ends 21A and 21B, respectively, thereby to output a high-frequency signal having the composite power from the input/output end 11 of the hollow waveguide 10B. The coaxial-waveguide-to-hollow-waveguide transition circuit 6 can also function as a power distributor for distributing power of a high-frequency signal input to the input/output end 11 of the hollow waveguide 10B into two pieces of power and outputting a high-frequency signal having one of the two pieces of power from the input/output end 21A of the coaxial waveguide 20A while outputting a high-frequency signal having the other piece of power from the input/output end 21B of the coaxial waveguide 20B.

A structure of the hollow waveguide 10B is the same as that of the hollow waveguide 10 of the first embodiment except that two coaxial waveguides 20A and 20B are coupled to a wide wall 16B. The hollow waveguide 108 of the present embodiment has a pair of narrow walls 13 and 14 forming short sides of a rectangular cross section of the hollow waveguide 10B and a pair of wide walls 15 and 16B forming long sides of the rectangular cross section. The narrow walls 13 and 14 and the wide walls 15 and 16B form the internal path 108*h* of the hollow waveguide 10B. The narrow walls 13 and 14 are E-planes parallel to the electric field, and the wide walls 15 and 16B are H-planes parallel to the magnetic field.

As illustrated in FIGS. 16 and 17, the coaxial waveguide 20A is located outside the hollow waveguide 10B, has an input/output end 21A on an end surface on the negative side of the Z-axis direction, and has an end physically coupled to the wide wall 16B of the hollow waveguide 10B on the positive side of the Z-axis direction. In addition, the coaxial waveguide 20A includes a conducting core wire 22A such as a copper wire that functions as a signal line, a ring-shaped outer conductor 24A concentrically surrounding the conducting core wire 22A, and an electrically insulative dielectric 23A which is interposed between the conducting core wire 22A and the outer conductor 24A. An end 22Ap (hereinafter also referred to as "insertion end 22Ap") of the conducting core wire 22A is inserted into the internal path 10Bh and located so as to protrude from the end of the coaxial waveguide 20A in the positive direction of the Z-axis.

The other coaxial waveguide 208 has the same structure as that of the coaxial waveguide 20A. That is, the coaxial waveguide 20B is located outside the hollow waveguide 10B, has an input/output end 21B on an end surface on the negative side of the Z-axis direction, and has an end physically coupled to the wide wall 16B of the hollow waveguide 10B on the positive side of the Z-axis direction. In addition, the coaxial waveguide 20B includes a conducting core wire 22B such as a copper wire that functions as a signal line, a ring-shaped outer conductor 24B concentrically surrounding the conducting core wire 22B, and an electrically insulative dielectric 23B which is interposed between the conducting core wire 22B and the outer conductor 24B. An end 228*p* (hereinafter also referred to as "insertion end 22Bp") of the conducting core wire 22B is inserted into the internal path 10Bh and located so as to protrude from the end of the coaxial waveguide 20B in the positive direction of the Z-axis.

Next, as illustrated in FIGS. 15 to 17, each of the strip conductors 30F and 30G is a member in the form of a plate made from metal and located so as to extend in the waveguide-axis direction (X-axis direction) in the internal path 108*h* of the hollow waveguide 10B. In order to a short-circuit connection between a short-circuit surface 12 of the hollow waveguide 10B and the insertion end 22Ap of the conducting core wire 22A protruding into the internal path 108*h*, the strip conductor 30F has a connection end (first connection end) 31F connected to the tip of the insertion end 22Ap and a connection end (second connection end) 32F connected to the short-circuit surface 12 of the hollow waveguide 10B while in contact therewith. In order to make a short-circuit connection between the short-circuit surface 12 of the hollow waveguide 10B and the insertion end 22Bp of the conducting core wire 22B protruding into the internal path 108*h*, the other strip conductor 30G has a connection end (first connection end) 31G connected to the tip of the insertion end 22Bp and a connection end (second connection end) 32G connected to the short-circuit surface 12 of the hollow waveguide 10B while in contact therewith. The connection ends 31F and 31G of the strip conductors 30F and 30G may be connected to the tips of the insertion ends 22Ap and 22Bp, respectively, by a conductive adhesive such as solder. The connection ends 31F and 31G and the insertion ends 22Ap and 22Bp form a probe of the coaxial-waveguide-to-hollow-waveguide transition circuit 6.

In addition, each of the strip conductors 30F and 30G has a front surface facing the wide wall 15, and a rear surface facing the other wide wall 16B. The front surface and the rear surface are arranged so as to be parallel to the wide walls 15 and 16B, respectively. Furthermore, the thickness of the strip conductors 30F and 30G is thinner than the inner diameter D1 between the wide walls 15 and 16B. Specifically, the thickness may be, for example, less than or equal to one fifth of the inner diameter D1. Because the strip conductor 30 has such location and thickness, disturbance of the electric field distribution in the internal path 10Bh can be suppressed.

Furthermore, the length L1 of the strip conductors 30F and 30G between the center of the connection ends 31F and 31G forming probes and contact surfaces of the connection ends 32F and 32G, respectively, with respect to the short-circuit surface 12 is designed to be approximately equal to an odd multiple of one quarter ($=\lambda_g/4$) of a wavelength $\lambda_g$ of a high-frequency signal in the strip conductors 30F and 30G.

The connection ends 31F and 31G of the strip conductors 30F and 30G are short-circuited to the short-circuit surface 12 of the hollow waveguide 10B. Therefore, the impedance when viewing the short-circuit surface 12 that is apart from the connection ends 31F and 31G forming the probes by a distance of an odd multiple of $\lambda_g/4$ (corresponding to an electrical length of 90 degrees) is substantially infinite (open state). Therefore, it is possible to electrically create a state equivalent to a state in which the strip conductors 30F and 30G are not connected. Therefore, the strip conductors 30F and 30G electrically do not affect the electric field distribution inside the hollow waveguide 10B nor the impedance of the probe. The coaxial-waveguide-to-hollow-waveguide transition circuit 6 of the present embodiment is capable of coupling high-frequency signals propagated in the coaxial waveguides 20A and 20B in a coaxial mode with a transmission mode (for example, the $TE_{10}$ mode) of the hollow waveguide 10B in terms of the electric field and outputting the high-frequency signal of the transmission mode from the input/output end 11 of the hollow waveguide 10B. As a result, broad-band characteristics can be implemented.

Moreover, even when high electric power is input to the input/output ends 21A and 21B of the coaxial waveguides 20A and 20B, the heat generated at the probes is transferred through the strip conductors 30F and 30G and dissipated through the wall of the hollow waveguide 10B. Therefore, deformation of the probe due to the heat can be prevented. Therefore, electrical characteristics of the coaxial-waveguide-to-hollow-waveguide transition circuit 6 is not degraded, and good broad-band characteristics can be maintained.

Note that the configuration of the present embodiment may be modified such that the end of the strip conductor is held to the narrow wall 13 using the fastening member 41 or 42 as in the second embodiment (FIG. 6) or the third embodiment (FIGS. 7 and 8). Furthermore, instead of the connection ends 31F and 31G of the present embodiment, the connection end 31B (FIGS. 9 and 10) of the fourth embodiment may be used.

As described above, the coaxial-waveguide-to-hollow-waveguide transition circuit 6 of the seventh embodiment has a structure that can maintain good broad-band characteristics without degrading electrical characteristics even when high electric power is input. In addition, the coaxial-waveguide-to-hollow-waveguide transition circuit 6 of the present embodiment can operate as a two-input and one-output power combiner and can further operate as a one-input and two-output power distributor.

Note that in the present embodiment, two coaxial waveguides 20A and 208 are coupled to one hollow waveguide 10B. Alternatively, in a coaxial-waveguide-to-hollow-waveguide transition circuit, M (where M is an integer larger than or equal to 3) coaxial waveguides may be coupled to one hollow waveguide 10B. This coaxial-waveguide-to-hollow-waveguide transition circuit can operate as an M-input and one-output power combiner and can further operate as a one-input and M-output power distributor.

Eighth Embodiment

In the first to seventh embodiments, the width of the strip conductors 30 and 30A to 30G are constant, although no limitation thereto is intended. The width of any one of the strip conductors 30 and 30A to 30G may be partially modified to be wider or narrower. Partial modification of the width allows the physical length of the strip conductors to be modified while the electrical length of 90 degrees (corresponding to an odd multiple of $\lambda_g/4$) is secured, and thus the degree of design freedom is increased. In the following, eighth and ninth embodiments, each of which includes a strip conductor having a width not constant over the entire length thereof, will be described.

Figure 18:
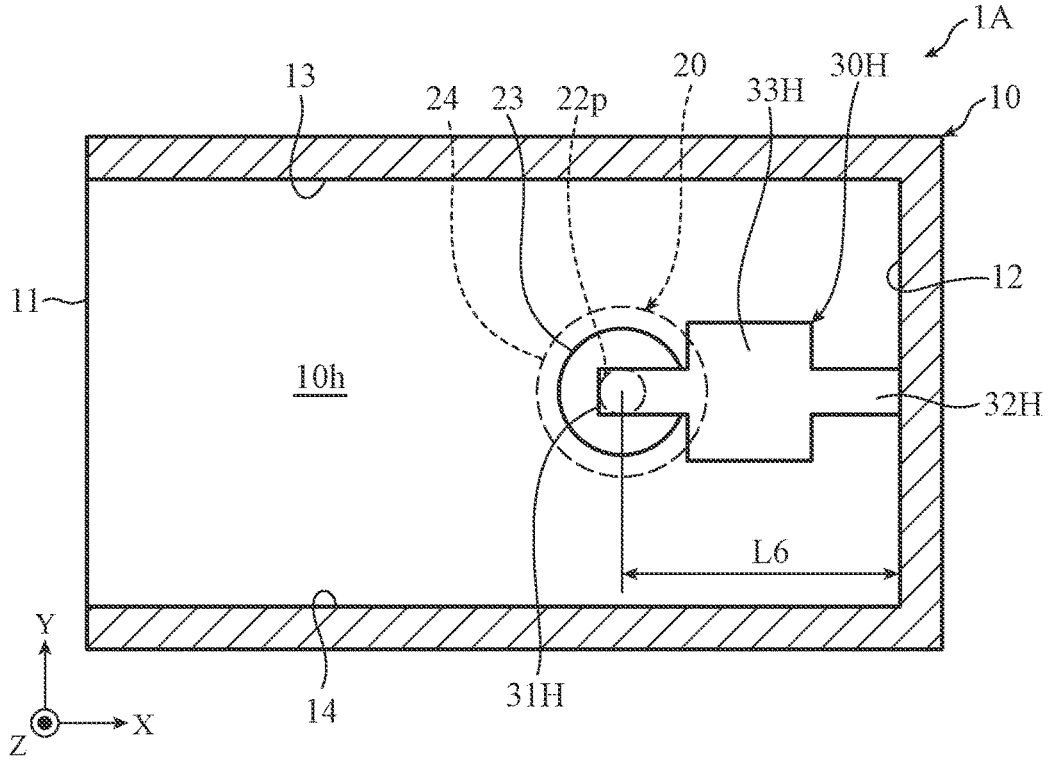
FIG. 18 is a schematic cross-sectional view illustrating a configuration of a coaxial-waveguide-to-hollow-waveguide transition circuit according to an eighth embodiment which is a modification of the first embodiment.

FIG. 18 is a schematic cross-sectional view illustrating a configuration of a coaxial-waveguide-to-hollow-waveguide transition circuit 1A according to the eighth embodiment which is a modification of the first embodiment. A configuration of the coaxial-waveguide-to-hollow-waveguide transition circuit 1A is the same as that of the coaxial-waveguide-to-hollow-waveguide transition circuit 1 of the first embodiment except that a strip conductor 30H having a different shape from that of the strip conductor 30 of FIG. 1 is included.

As illustrated in FIG. 18, this strip conductor 30H has a connection end (first connection end) 31H connected to a tip of an insertion end 22*p* of a conducting core wire 22, a connection end 32E connected to a short-circuit surface 12 while in contact therewith, and a line portion 33H having a width wider than the width of the connection end 31H between the connection ends 31H and 32E. The length L6 of the strip conductor 30H between the center of the connection end 31H forming a probe and a contact surface of the connection end 32H with respect to the short-circuit surface 12 is designed to be approximately equal to an odd multiple of one quarter ($=\lambda_g/4$) of a wavelength (wavelength on the transmission line) $\lambda_g$ of a high-frequency signal in the strip conductor 30H.

Ninth Embodiment

Figure 19:
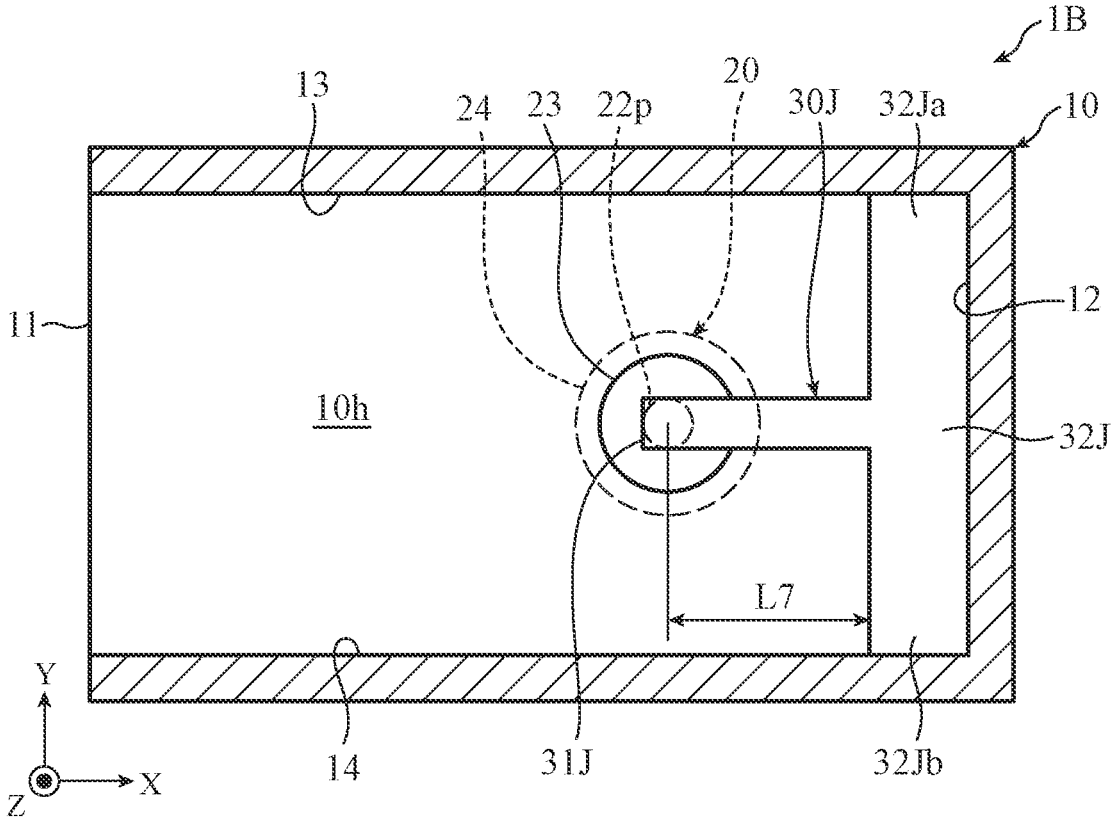
FIG. 19 is a schematic cross-sectional view illustrating a configuration of a coaxial-waveguide-to-hollow-waveguide transition circuit according to a ninth embodiment which is another modification of the first embodiment.

FIG. 19 is a schematic cross-sectional view illustrating a configuration of a coaxial-waveguide-to-hollow-waveguide transition circuit 1B according to the ninth embodiment which is another modification of the first embodiment. A configuration of the coaxial-waveguide-to-hollow-waveguide transition circuit 1B is the same as that of the coaxial-waveguide-to-hollow-waveguide transition circuit 1 of the first embodiment except that a strip conductor 30J having a different shape from that of the strip conductor 30 of FIG. 1 is included.

As illustrated in FIG. 19, the strip conductor 30J has a connection end (first connection end) 31J connected to a tip of an insertion end 22*p* of a conducting core wire 22 and a connection end 32J connected to all of a short-circuit surface 12 and narrow walls 13 and 14 while in contact therewith. The length L7 of the strip conductor 30J between the center of the connection end 31J forming a probe and the connection end 32J is designed to be approximately equal to an odd multiple of one quarter ($=\lambda_g/4$) of a wavelength (wavelength on the transmission line) $\lambda_g$ of a high-frequency signal in the strip conductor 30J. Therefore, like in the case of the first embodiment, it is possible to electrically create a state equivalent to a state in which the strip conductor 30J is not connected.

Moreover, the width of the connection end 32J in the Y-axis direction is larger than the width of the connection end 31J. An end surface of the connection end 32J on the positive side of the X-axis direction is in contact with the short-circuit surface 12, and both the end surfaces of the connection end 32J in the Y-axis direction are in contact with narrow walls 13 and 14. Because a contact area between the connection end 32J and inner walls of the hollow waveguide 10 is large, high heat radiation performance can be obtained. Therefore, it is possible to further improve durability against high electric power.

Although the various embodiments of the first to ninth embodiments according to the present invention have been described with reference to the drawings, the first to ninth embodiments are examples of the present invention, and thus various forms other than the first to ninth embodiments can be adopted.

Figure 20:
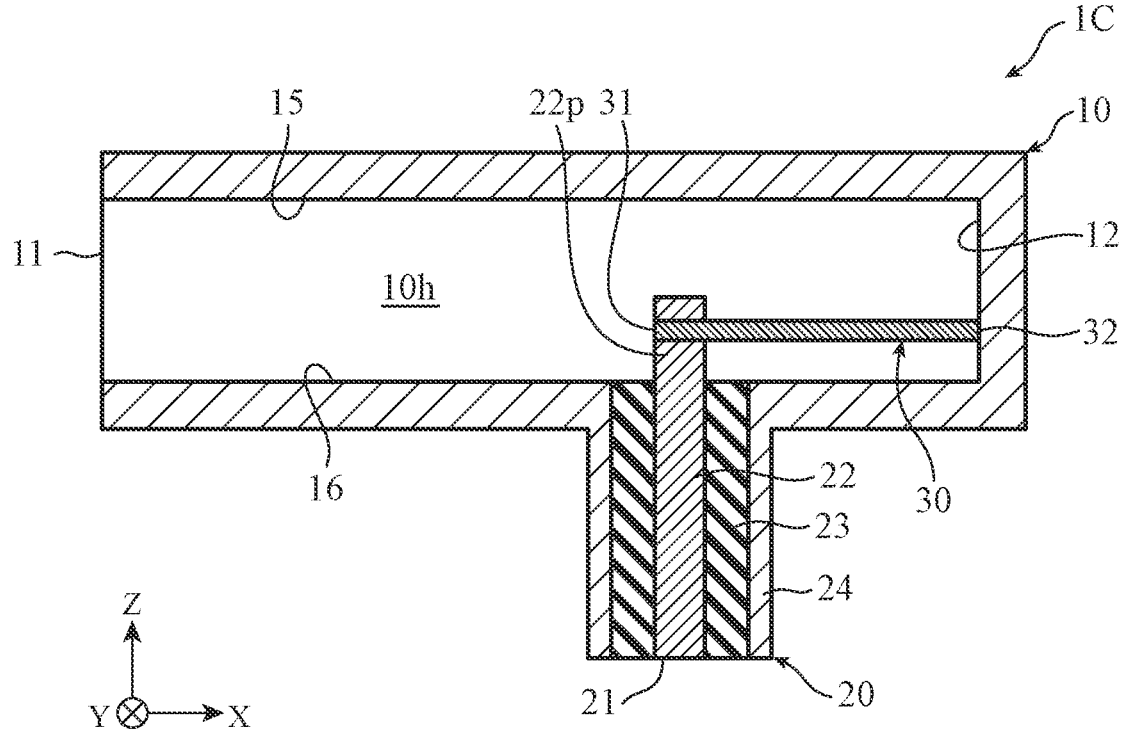
FIG. 20 is a schematic cross-sectional view illustrating a configuration of a coaxial-waveguide-to-hollow-waveguide transition circuit which is still another modification of the first embodiment.

For example, in the first embodiment, the connection end 31 of the strip conductor 30 is connected to the tip of the insertion end 22*p*. Instead of this, as in the coaxial-waveguide-to-hollow-waveguide transition circuit 1C of FIG. 20, a connection end 31 of a strip conductor 30 may be connected to an insertion end 22*p* at a position closer to a coaxial waveguide 20 than a tip of the insertion end 22*p* is. A configuration of the coaxial-waveguide-to-hollow-waveguide transition circuit 1C of FIG. 20 is the same as that of the coaxial-waveguide-to-hollow-waveguide transition circuit 1 of the first embodiment except that the position where the connection end 31 of the strip conductor 30 is connected to the insertion end 22*p* is different.

Figure 21:
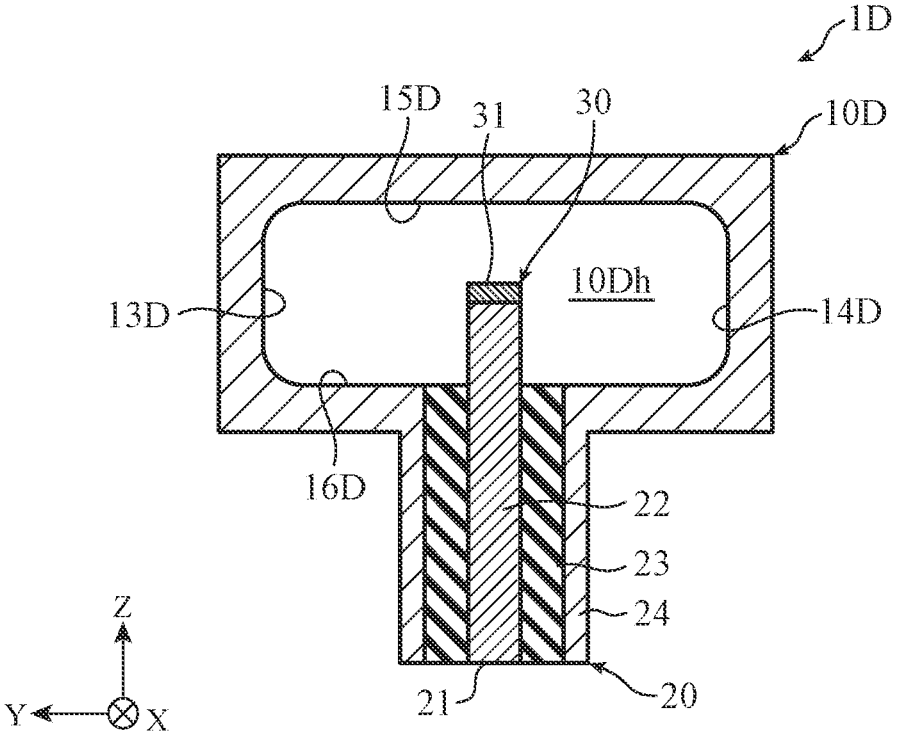
FIG. 21 is a schematic diagram illustrating a cross-sectional configuration of a coaxial-waveguide-to-hollow-waveguide transition circuit which is yet another modification of the first embodiment.

Also, because the cross-sectional shapes of the internal paths of the hollow waveguides 10, 10A, and 10B are all rectangular, four corners of any of the rectangular shapes have right angles in which two long sides and two short sides are orthogonal to each other at 90 degrees. Instead of the hollow waveguides 10, 10A, and 10B having such right angle corners, hollow waveguides having curved corners such as arc shapes or partially oval shapes having a constant curvature may be used. FIG. 21 is a schematic diagram illustrating a cross-sectional structure of a coaxial-waveguide-to-hollow-waveguide transition circuit 1D having a hollow waveguide 10D having such curved corners. The hollow waveguide 10D illustrated in FIG. 21 has a pair of narrow walls 13D and 14D facing each other and a pair of wide walls 15D and 16D facing each other. At four corners of the internal path 10Dh, corners where the narrow walls 13D and 14D intersect the wide walls 15D and 16D have curved shapes.

Within the scope of the present invention, an arbitrary combination of the first to ninth embodiments, a modification of any component of the respective embodiments, or omission of any component in the respective embodiments is possible.

INDUSTRIAL APPLICABILITY

Because a coaxial-waveguide-to-hollow-waveguide transition circuit according to the present invention is used in a high-frequency transmission path for transmitting a signal in a high-frequency band such as the VHF band, the UHF band, the millimeter wave band or the microwave band, and thus is suitable for use in an antenna device, a radar device, and a communication device.

REFERENCE SIGNS LIST

1, 1A to 1D, 2 to 5, 5A, 58, 6: Coaxial-waveguide-to-hollow-waveguide transition circuits; 10, 10A, 10B, 10D: Hollow waveguides; 11: Input/output end; 12, 12A: Short-circuit surfaces (termination surfaces); 13, 13D, 14, 14D: Narrow walls; 15, 15D, 16, 16B, 16D: Wide walls; 17: Mounting portion; 20, 20A, 20B: Coaxial waveguides; 21, 21A, 21B: Input/output ends; 22, 22A, 22B: Conducting core wire s; 22*p*, 22Ap, 22Bp: Insertion ends; 23, 23A, 23B: Dielectrics; 24, 24A, 24B: Outer conductors; 30, 30A to 30H, 30J: Strip conductors; 31, 31B, 31F, 31G, 31E, 31H: Connection ends; 32, 32A, 32C, 32Da, 32Db, 32Ea, 32Eb, 32F to 32H, 32J: Connection ends; 33, 33H: Line portions; 34: Bent portion; 35: Branch line portion; 36*a*, 36*b*: Bended portions; and 41, 42: Fastening members.

The invention claimed is:

1. A coaxial-waveguide-to-hollow-waveguide transition circuit, comprising:

a hollow waveguide having a pair of long sides facing each other and a pair of short sides facing each other in a cross section perpendicular to a waveguide-axis direction thereof, the hollow waveguide having, as inner walls, a pair of wide walls forming the pair of long sides and a pair of narrow walls forming the pair of short sides;

at least one coaxial waveguide located outside the hollow waveguide and having an end coupled to one wide wall of the pair of wide walls; and a strip conductor located inside an internal path of the hollow waveguide, wherein the hollow waveguide has a termination surface in one end of the hollow waveguide in the waveguide-axis direction, the at least one coaxial waveguide includes at least one conducting core wire extending from the end of the at least one coaxial waveguide into the internal path of the hollow waveguide, and the strip conductor makes a short-circuit connection between the at least one conducting core wire and at least one of the termination surface and at least one narrow wall of the pair of narrow walls, and includes a first connection end connected to the at least one conducting core wire, and a second connection end connected to either the termination surface or the at least one narrow wall, wherein a length of the strip conductor between the first connection end and the second connection end is equal to an odd multiple of a quarter of a wavelength of a high-frequency signal in the strip conductor.

2. The coaxial-waveguide-to-hollow-waveguide transition circuit according to claim 1, wherein:

the strip conductor is a member in a form of a plate having a front surface and a rear surface which are opposed to the pair of wide walls; and the front surface and the rear surface are arranged to be parallel to the pair of wide walls, respectively.

3. The coaxial-waveguide-to-hollow-waveguide transition circuit according to claim 2, wherein a thickness of the strip conductor is less than or equal to one fifth of a distance between the pair of wide walls in a direction parallel to the pair of short sides.

4. The coaxial-waveguide-to-hollow-waveguide transition circuit according to claim 3, wherein the first connection end has an outer dimension larger than an outer dimension of the at least one conducting core wire.

5. The coaxial-waveguide-to-hollow-waveguide transition circuit according to claim 3, wherein the strip conductor further includes a line portion that has a width wider than a width of the first connection end between the first connection end and the second connection end.

6. The coaxial-waveguide-to-hollow-waveguide transition circuit according to claim 3, wherein a width of the second connection end is wider than a width of the first connection end.

7. The coaxial-waveguide-to-hollow-waveguide transition circuit according to claim 1, wherein:

the at least one coaxial waveguide includes a plurality of coaxial waveguides that have respective ends connected to the pair of wide walls; and the at least one conducting core wire includes a plurality of conducting core wires that extend from the respective ends of the plurality of coaxial waveguides into the internal path.

8. The coaxial-waveguide-to-hollow-waveguide transition circuit according to claim 1, further comprising a fastening member configured to hold the second connection end to either the termination surface or the at least one narrow wall.

9. The coaxial-waveguide-to-hollow-waveguide transition circuit according to claim 1, wherein the first connection end has an outer dimension larger than an outer dimension of the at least one conducting core wire.

10. The coaxial-waveguide-to-hollow-waveguide transition circuit according to claim 1, wherein the strip conductor further includes a line portion that has a width wider than a width of the first connection end between the first connection end and the second connection end.

11. The coaxial-waveguide-to-hollow-waveguide transition circuit according to claim 1, wherein a width of the second connection end is wider than a width of the first connection end.

* * * * *